US010443308B2

(12) United States Patent
Gharib

(10) Patent No.: US 10,443,308 B2
(45) Date of Patent: Oct. 15, 2019

(54) DRILLING APPARATUS WITH A FIXED INTERNALLY TILTED DRIVESHAFT

(71) Applicant: Halliburton Energy Services, Inc., Houston, TX (US)

(72) Inventor: Hossam Gharib, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 98 days.

(21) Appl. No.: 15/576,403

(22) PCT Filed: Jul. 2, 2015

(86) PCT No.: PCT/CA2015/050618

§ 371 (c)(1),
(2) Date: Nov. 22, 2017

(87) PCT Pub. No.: WO2017/000053

PCT Pub. Date: Jan. 5, 2017

(65) Prior Publication Data

US 2018/0155986 A1 Jun. 7, 2018

(51) Int. Cl.
*E21B 7/06* (2006.01)
*E21B 4/02* (2006.01)
(Continued)

(52) U.S. Cl.
CPC ..... *E21B 7/067* (2013.01); *E21B 4/003* (2013.01); *E21B 4/02* (2013.01); *E21B 7/04* (2013.01); *E21B 7/062* (2013.01); *E21B 17/1078* (2013.01)

(58) Field of Classification Search
CPC . E21B 4/003; E21B 7/067; E21B 4/02; E21B 7/062; E21B 7/04; E21B 17/1078;
(Continued)

(56) References Cited

U.S. PATENT DOCUMENTS 4,246,964 A 1/1981 Brandell
4,597,454 A 7/1986 Schoeffler
(Continued)

FOREIGN PATENT DOCUMENTS

RU 2029048 C1 2/1995
WO 2014098842 A1 6/2014

OTHER PUBLICATIONS

Offshore Magazine, Article Entitled "Rotary steerable systems provide advantages, opportunities", vol. 65, Issue 4, downloaded from "http://www.offshore-mag.com/articles/print/volume-65/issue-4/drilling-completion/rotary-steerable-systems-provide-advantages-opportunities.html", Apr. 1, 2005 (10 pages).
(Continued)

*Primary Examiner* — Wei Wang
(74) *Attorney, Agent, or Firm* — Terrence N. Kuharchuk; Parlee McLaws LLP; Craig W. Roddy

(57) ABSTRACT

A drilling apparatus having a drive section and a bearing section axially distal to the drive section. The bearing section includes a bearing housing having a bearing housing bore defining a bearing housing bore axis, a sleeve assembly received within the bearing housing bore, the sleeve assembly having a sleeve assembly bore defining a sleeve assembly bore axis, a driveshaft received within the sleeve assembly bore, and a bearing assembly for rotatably supporting the driveshaft within the sleeve assembly bore. The sleeve assembly includes a plurality of axially arranged sleeve sections. The sleeve assembly bore axis is oblique to the bearing housing bore axis. The sleeve sections may be received within the bearing housing bore so that they maintain a fixed angular position relative to each other and relative to the bearing housing, and so that they maintain a fixed axial position relative to the bearing housing.

20 Claims, 17 Drawing Sheets

(51) Int. Cl.
*E21B 4/00* (2006.01)
*E21B 7/04* (2006.01)
*E21B 17/10* (2006.01)

(58) Field of Classification Search
CPC .. E21B 4/00; E21B 10/22; F16C 17/00; F16C 17/04; F16C 25/04; F16C 27/02; F16C 27/08; F16C 19/14; F16C 19/30; F16C 33/04; F01C 21/02
See application file for complete search history.

(56) References Cited

U.S. PATENT DOCUMENTS 4,655,299 A 4/1987 Schoeffler
4,811,798 A 3/1989 Falgout, Sr. et al.
5,048,621 A 9/1991 Bailey et al.
5,305,838 A 4/1994 Pauc
5,427,177 A 6/1995 Jordan, Jr. et al.
5,495,900 A 3/1996 Falgout, Sr.
6,092,610 A * 7/2000 Kosmala ..... E21B 4/20 175/61
6,216,802 B1 4/2001 Sawyer
6,364,034 B1 4/2002 Schoeffler
7,195,083 B2 3/2007 Eppink et al.
7,287,607 B1 10/2007 Falgout, Sr.
7,360,609 B1 4/2008 Falgout, Sr.
8,141,658 B2 3/2012 Blair et al.
8,157,025 B2 4/2012 Johnson
8,286,732 B2 10/2012 Walker et al.
8,448,721 B2 5/2013 Johnson
8,721,182 B2 5/2014 Cioceanu
8,900,062 B2 12/2014 Nicol-Seto
8,915,312 B2 12/2014 Villarreal et al.
8,919,458 B2 12/2014 Plop
2013/0168152 A1 7/2013 Panahi
2013/0264119 A1 10/2013 Gynz-Rekowski et al.
2014/0008127 A1 1/2014 Plessis et al.
2014/0182941 A1 7/2014 Oppelaar
2014/0251695 A1 9/2014 Marchand et al.

OTHER PUBLICATIONS

Drilling Contractor, Article Entitled "Rotary steerable drilling: faster, smoother wellbores", Nov./Dec. 2002, pp. 30-31.
Weatherford, Brochure entitled "Revolution Rotary-Steerable System", Weatherford.com, 2015, pp. 1-12.

* cited by examiner

DRILLING APPARATUS WITH A FIXED INTERNALLY TILTED DRIVESHAFT

TECHNICAL FIELD

A drilling apparatus having a fixed internally tilted driveshaft.

BACKGROUND OF THE INVENTION

A drilling apparatus may include a drive section and a bearing section. The bearing section may be axially distal to the drive section. The bearing section may include a driveshaft rotatably supported within a bearing housing. The driveshaft may be driven by the drive section.

BRIEF DESCRIPTION OF DRAWINGS

Embodiments of the invention will now be described with reference to the accompanying drawings, in which.

DETAILED DESCRIPTION

Figure 1:
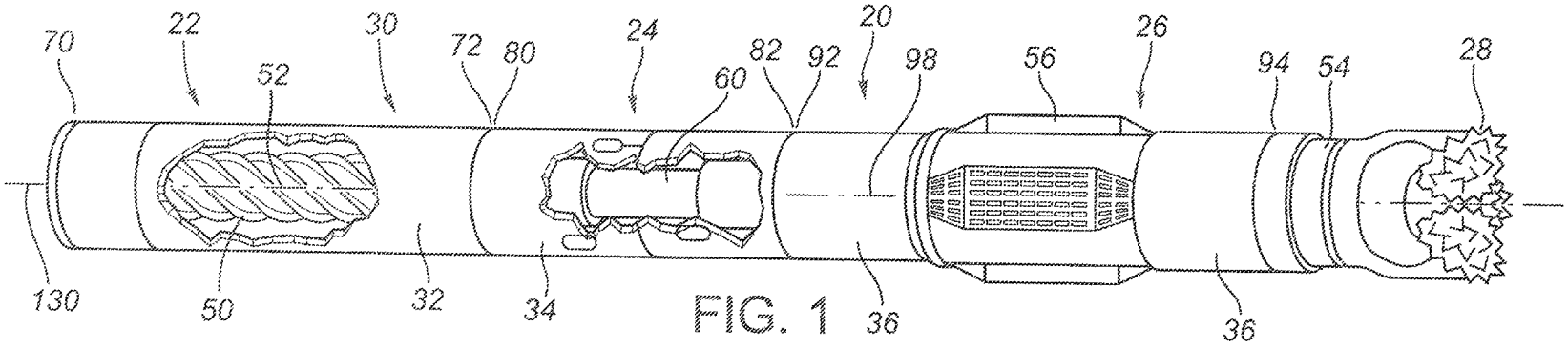
FIG. 1 is a partial cutaway pictorial view of components of a drilling apparatus.

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

References in this document to "proximal" means located relatively toward an intended "uphole" end, "upper" end and/or "surface" end of a borehole or of an apparatus or pipe string positioned in a borehole.

References in this document to "distal" means located relatively away from an intended "uphole" end, "upper" end and/or "surface" end of a borehole or of an apparatus or pipe string positioned in a borehole.

The present disclosure is directed at a drilling apparatus and at specific features of a drilling apparatus. The drilling apparatus may be configured to be inserted and/or contained and/or used within a borehole. The drilling apparatus may be used for drilling a borehole.

The drilling apparatus may comprise any apparatus which is suitable for drilling. The drilling apparatus may comprise, consist of, or consist essentially of a rotary steerable apparatus for use in drilling a borehole. The drilling apparatus may comprise, consist of, or consist essentially of a drilling motor for use in drilling a borehole.

The drilling apparatus may comprise, consist of, or consist essentially of a positive displacement drilling motor. The drilling apparatus may comprise, consist of, or consist essentially of a progressing cavity drilling motor, including but not limited to a Moineau-type progressing cavity motor.

The drilling apparatus may be deployed in a borehole in any suitable manner. The drilling apparatus may be configured to be deployed in a borehole on a drill string extending from the surface of the borehole. The drill string may comprise lengths of drill pipe, casing, or tubing connected together. The drill string may comprise a coiled tubing. The drill string may comprise a wireline or a slickline.

The drilling apparatus may comprise a drive section and a bearing section, which may be configured in any suitable manner relative to each other. As a non-limiting example, the bearing section may be axially distal to the drive section.

The drive section provides drive energy for driving the drilling apparatus. The drive section may comprise any structure, device or apparatus which is capable of generating and/or transmitting drive energy to the bearing section of the drilling apparatus.

Drive energy may be both generated by and transmitted by the drive section to the bearing section, or drive energy may be generated elsewhere and transmitted by the drive section to the bearing section. As non-limiting examples, the drive energy may be rotational drive energy.

As a first non-limiting example, rotational drive energy for a rotary steerable drilling apparatus in a borehole may be generated by a motor at the surface of the borehole which rotates a drill string from the surface, and the drive section may transmit the rotational drive energy to the bearing section. As a second non-limiting example, rotational drive energy for a rotary steerable drilling apparatus in a borehole may be generated by a motor located in the borehole uphole of the rotary steerable drilling apparatus, and the drive section may transmit the rotational drive energy to the bearing section. As a third non-limiting example, rotational drive energy for a drilling motor may be generated by a power section of the drilling motor as the drive section, and the power section of the drilling motor may both generate the rotational drive energy and transmit the rotational drive energy to the bearing section.

The drive section may comprise a drive member. The drive member may comprise any suitable structure or suitable combination of structures which is capable of transmitting drive energy to the bearing section. As a non-limiting example, the drive member may comprise a component of a drill string. As a non-limiting example, the drive member may comprise a structure which is connected directly or indirectly with a component of a drill string. As a non-limiting example, the drive member may comprise an output shaft of a drilling motor, such as a rotor in a drilling motor. As a non-limiting example, the drive member may comprise a structure which is connected directly or indirectly with an output shaft of a drilling motor.

The drive section may or may not comprise a drive housing. The drive housing may comprise a plurality of drive housing components which may be connected in any suitable manner, or the drive housing may be a unitary drive housing which consists of a single drive housing component.

The drive housing may have a proximal drive housing end, a distal drive housing end, and a drive housing bore. The drive member may be received within the drive housing.

The drilling apparatus may or may not comprise a transmission section. The transmission section may be axially located at any suitable position within the drilling apparatus. As a non-limiting example, the transmission section may be axially located between the drive section and the bearing section in order to provide a linkage between the drive section and the bearing section.

The transmission section may comprise any structure, device or apparatus which is capable of enabling the drive section to transmit drive energy from the drive section to the bearing section.

The transmission section may comprise a transmission member. The transmission member may comprise any suitable structure or suitable combination of structures which is capable of transmitting drive energy to the bearing section. The transmission member may comprise a single transmission member component or may comprise a plurality of transmission member components. As a first non-limiting example, the transmission member may comprise a substantially stiff shaft and one or more articulating connections. As a second non-limiting example, the transmission member may comprise a flex shaft. As a third non-limiting example, the transmission member may comprise a connector or simply a connection between a drive member and the bearing section.

The transmission section may or may not comprise a transmission housing. The transmission housing may comprise a plurality of transmission housing components which may be connected in any suitable manner, or the transmission housing may be a unitary transmission housing which consists of a single transmission housing component.

The transmission housing may have a proximal transmission housing end, a distal transmission housing end, and a transmission housing bore. The transmission member may be received within the transmission housing bore.

The bearing section may comprise a bearing housing, a driveshaft, and a bearing assembly.

The bearing housing may comprise any suitable structure or suitable combination of structures. The bearing housing may comprise a plurality of bearing housing components which may be connected in any suitable manner, or the bearing housing may be a unitary bearing housing which consists of a single bearing housing component.

The bearing housing has a proximal bearing housing end and a distal bearing housing end. The bearing housing defines a bearing housing bore. The bearing housing has a bearing housing axis which is defined by the exterior of the bearing housing. The bearing housing has a bearing housing bore axis which is defined by the bearing housing bore.

The driveshaft is received within the bearing housing bore and is rotatable relative to the bearing housing.

The driveshaft may comprise any suitable structure or suitable combination of structures. The driveshaft may comprise a plurality of driveshaft components which may be connected in any suitable manner, or the driveshaft may be a unitary driveshaft which consists of a single driveshaft component.

If the drilling apparatus comprises a transmission section, the transmission section may be located at any axial position between the drive section and the bearing section, and may be connected directly or indirectly with the drive section and the bearing section.

As a non-limiting example, the transmission section may be connected directly with the drive section or the bearing section, or the transmission section may be connected directly with both the drive section and the bearing section. The distal drive housing end of the drive housing of the drive section may be connected directly with the proximal transmission housing end of the transmission housing so that the drive housing is connected directly with the transmission housing. The distal transmission housing end of the transmission housing of the transmission section may be connected directly with the proximal bearing housing end of the bearing housing so that the transmission housing is connected directly with the bearing housing.

The drilling apparatus has a primary axis. The primary axis of the drilling apparatus is the axis of components or sections of the drilling apparatus which are located toward the proximal end of the drilling apparatus. The primary axis of the drilling apparatus may be defined by or may be parallel to the axis of the drive section of the drilling apparatus.

The driveshaft has a driveshaft axis. The driveshaft axis is the axis of rotation of the driveshaft within the bearing housing.

The driveshaft axis may be oblique (i.e., non-parallel) to the primary axis of the drilling apparatus so that there is an angle between the driveshaft axis and the primary axis and so that the driveshaft is tilted relative to the primary axis. If the driveshaft axis is oblique to the primary axis of the drilling apparatus, the drilling apparatus may be described as a "bent" drilling apparatus, and may be suitable for use in directional drilling.

The drilling apparatus may be configured in any suitable manner in order to provide that the driveshaft axis is oblique to the primary axis. One or more sections of the drilling apparatus may be configured to provide that the driveshaft axis is oblique to the primary axis.

The bearing section may be configured to provide that the driveshaft axis is oblique to the primary axis. The bearing section may comprise an angular offset which causes the driveshaft axis to be oblique to the primary axis. The angular offset may comprise any feature or combination of features of the bearing section which are capable of providing the angular offset.

As a first non-limiting example, an angular offset within the bearing section may comprise a bend in the bearing housing so that the angular offset is provided in both the bearing housing axis and the bearing housing bore axis. Such an angular offset may be described as an "external bend" in the bearing housing.

As a second non-limiting example, an angular offset within the bearing section may comprise a bearing housing bore axis which is oblique to the bearing housing axis. Such an angular offset may be described as an "internal bend" in the bearing housing.

As a third non-limiting example, the bearing section may comprise a structure, device or apparatus which is received within the bearing housing bore and an angular offset within the bearing section may be provided by the structure, device or apparatus. As a non-limiting example, the structure, device or apparatus may comprise a sleeve assembly. Such an angular offset may be described as an "internal bend" in the bearing housing.

An angular offset within the bearing section may therefore be achieved either partly or completely by a structure, device or apparatus such as a sleeve assembly which is received within the bearing housing bore and which provides an angular offset.

The sleeve assembly may define a sleeve assembly bore. The sleeve assembly may have a sleeve assembly axis which is defined by the exterior of the sleeve assembly. The sleeve assembly may have a sleeve assembly bore axis which is defined by the sleeve assembly bore. The sleeve assembly axis may be parallel to the housing bore axis, and the sleeve assembly bore axis may be oblique to the bearing housing bore axis.

The driveshaft may be received within bearing housing bore by being received within the sleeve assembly bore so that the driveshaft axis is defined by the sleeve assembly bore axis.

The bearing housing axis may be parallel with the bearing housing bore axis so that the angular offset within the bearing section is achieved completely by the sleeve assembly. Alternatively, the angular offset within the bearing section may be achieved by a combination of the sleeve assembly and one or more other angular offsets comprising an external bend or an internal bend of the bearing section.

The sleeve assembly may comprise one sleeve section or any number of a plurality of sleeve sections. A plurality of sleeve sections may be axially arranged within the bearing housing bore. A plurality of sleeve sections may be axially arranged within the bearing housing bore in any suitable manner. As a non-limiting example, a plurality of sleeve sections may be axially arranged within the bearing housing bore end-to-end so that the ends of adjacent sleeve sections contact each other.

A plurality of sleeve sections may be axially arranged within the bearing housing bore so that following assembly of the drilling apparatus, each of the sleeve sections maintains a fixed angular position relative to the bearing housing. As used herein, "fixed angular position relative to the bearing housing" means that each of the sleeve sections is fixed relatively to the bearing housing and is not rotatable within the bearing housing bore relative to the bearing housing. A fixed angular position relative to the bearing housing may be achieved in any suitable manner.

Each of the sleeve sections may separately be non-rotatably connected or otherwise engaged with the bearing housing in order to achieve a fixed angular position between the sleeve sections and the bearing housing. Alternatively, one or more of the sleeve sections may be non-rotatably connected or otherwise engaged with the bearing housing, and the other sleeve sections may be non-rotatably connected or otherwise engaged, directly or indirectly, with those sleeve sections which are non-rotatably connected or otherwise engaged with the bearing housing in order to achieve a fixed angular position between the sleeve sections and the bearing housing. As a non-limiting example, a single sleeve section may be non-rotatably connected or otherwise engaged with the bearing housing, and the other sleeve sections may be non-rotatably connected or otherwise engaged, directly or indirectly, with the single sleeve section which is non-rotatably connected or otherwise engaged with the bearing housing.

A plurality of sleeve sections may be arranged within the bearing housing bore so that following assembly of the drilling apparatus, the sleeve sections maintain a fixed angular position relative to each other. As used herein, "fixed angular position relative to each other" means that the sleeve sections are fixed relative to each other and are not rotatable within the bearing housing bore relative to each other. A fixed angular position of the sleeve sections relative to each other may be achieved in any suitable manner.

As a non-limiting example, the sleeve sections may be non-rotatably interengaged with each other, directly or indirectly, in order to achieve a fixed angular position relative to each other. The sleeve sections may be non-rotatably interengaged with each other in any suitable manner. The sleeve sections may comprise complementary engagement surfaces, and the sleeve sections may be non-rotatably interengaged by the complementary engagement surfaces.

The complementary engagement surfaces may comprise any suitable surfaces which may be provided on the sleeve sections in any suitable manner and at any suitable location on the sleeve sections. As non-limiting examples, the complementary engagement surfaces may comprise interlocking splines, tabs and recesses, lugs and grooves, etc., which may be provided at or adjacent to the ends of the sleeve sections or at some other suitable location on the sleeve sections.

The sleeve sections may comprise pairs of adjacent sleeve sections and complementary engagement surfaces may be provided at suitable locations on the pairs of adjacent sleeve sections. The complementary engagement surfaces may be the same or similar on each pair of adjacent sleeve sections, or the complementary engagement surfaces may vary amongst pairs of adjacent sleeve sections.

The complementary engagement surfaces may be provided at or adjacent to the adjacent ends of a pair of adjacent sleeve sections.

As a non-limiting example, the complementary engagement surfaces may comprise at least one tab on one of a pair of adjacent sleeve sections and at least one recess on the other of a pair of adjacent sleeve sections. The at least one tab and the at least one recess may be provided at or adjacent to the adjacent ends of the pair of adjacent sleeve sections, or at some other suitable location.

As a non-limiting example, the complementary engagement surfaces may comprise at least one tab on one of the sleeve sections in each pair of adjacent sleeve sections and at least one recess on the other of the sleeve sections in each pair of adjacent sleeve sections. The tabs and recesses may be provided at or adjacent to the adjacent ends of the pairs of adjacent sleeve sections, or at some other suitable location or locations. The tabs and recesses may be the same or similar on each pair of adjacent sleeve sections, or the tabs and recesses may vary amongst pairs of adjacent sleeve sections.

The sleeve assembly may be received within the bearing housing bore such that following assembly of the drilling apparatus, the sleeve assembly maintains a fixed axial position relative to the bearing housing. If the sleeve assembly comprises a plurality of sleeve sections, the sleeve sections may be retained within the bearing housing bore such that following assembly of the drilling apparatus, each of the sleeve sections maintains a fixed axial position relative to the bearing housing. As used herein, "fixed axial position relative to the bearing housing" means that the sleeve assembly and/or each of the sleeve sections is axially fixed relatively to the bearing housing and is not translatable within the bearing housing bore relative to the bearing housing. A fixed axial position relative to the bearing housing may be achieved in any suitable manner, either directly or indirectly.

Each of the sleeve sections may separately be non-translatably connected or otherwise engaged directly with the bearing housing in order to achieve a fixed axial position between the sleeve sections and the bearing housing. Alternatively, one or more of the sleeve sections may be non-translatably connected or otherwise engaged directly with the bearing housing, and the other sleeve sections may be non-translatably connected or otherwise engaged, directly or indirectly, with those sleeve sections which are non-translatably connected or otherwise engaged with the bearing housing in order to achieve a fixed axial position between the sleeve sections and the bearing housing.

As a non-limiting example, the drilling apparatus may comprise a retaining shoulder extending radially into the bearing housing bore, one of the sleeve sections may be non-translatably connected directly with the bearing housing by a sleeve connection, and the sleeve sections may be retained within the housing bore between the retaining shoulder and the sleeve connection.

The retaining shoulder may comprise any suitable structure, device or apparatus, and may be associated with the bearing housing or with some other component of the drilling apparatus. As non-limiting examples, the retaining shoulder may comprise a discontinuity axially within the bearing housing bore or a discontinuity axially adjacent to the bearing housing bore. The retaining shoulder may further comprise one or more spacers for adjusting the distance between the retaining shoulder and the sleeve connection in order to accommodate the sleeve assembly. The one or more spacers may be constructed of any suitable material. The one or more spacers may be constructed of a relatively flexible and/or deformable material, including as non-limiting examples, Teflon™ or rubber.

The sleeve connection may comprise any suitable type of connection which is capable of non-translatably connecting the sleeve section with the bearing housing. As non-limiting examples, the sleeve connection may be achieved by a threaded connection, by one or more fasteners, welds or by an interference fit.

A sleeve section may be both non-rotatably connected or otherwise engaged directly with the bearing housing and non-translatably connected or otherwise engaged directly with the bearing housing by the sleeve connection so that following assembly of the drilling apparatus, the sleeve section maintains a fixed angular position relative to the bearing housing and a fixed axial position relative to the bearing housing. In such circumstances, the sleeve connection may comprise any suitable type of connection which is capable of both non-rotatably connecting or otherwise engaging the sleeve section with the bearing housing and non-translatably connecting or otherwise engaging the sleeve section with the bearing housing. As non-limiting examples, in such circumstances, the sleeve connection may be achieved by a threaded connection, by one or more fasteners, welds or by an interference fit.

Alternatively, separate sleeve sections may be non-rotatably connected or otherwise engaged directly with the bearing housing and non-translatably connected or otherwise engaged directly with the bearing housing, and/or separate connections may be provided to non-rotatably connect or otherwise engage and a non-translatably connect or otherwise engage a sleeve section directly with the bearing housing.

A sleeve assembly may comprise any number of one or more sleeve sections. The sleeve assembly may comprise a first sleeve section which is non-rotatably connected or otherwise engaged with the bearing housing either directly or indirectly and/or which is maintained in a fixed axial position relative to the bearing housing either directly or indirectly. The sleeve assembly may comprise a second sleeve section which is non-rotatably connected or otherwise engaged with the bearing housing either directly or indirectly and/or which is maintained in a fixed axial position relative to the bearing housing either directly or indirectly. The sleeve assembly may comprise a third sleeve section which is non-rotatably connected or otherwise engaged with the bearing housing either directly or indirectly and/or which is maintained in a fixed axial position relative to the bearing housing either directly or indirectly. The sleeve assembly may comprise a fourth sleeve section which is non-rotatably connected or otherwise engaged with the bearing housing either directly or indirectly and/or which is maintained in a fixed axial position relative to the bearing housing either directly or indirectly. The sleeve assembly may comprise a fifth sleeve section which is non-rotatably connected or otherwise engaged with the bearing housing either directly or indirectly and/or which is maintained in a fixed axial position relative to the bearing housing either directly or indirectly. The sleeve assembly may comprise any number of more than five sleeve sections.

A sleeve section such as a first sleeve section may be non-rotatably connected directly with the bearing housing and one or more additional sleeve sections may be non-rotatably connected or otherwise engaged indirectly with the bearing housing by being non-rotatably interengaged with the first sleeve section and with each other. A sleeve section such as a first sleeve section may be maintained directly in a fixed axial position relative to the bearing housing and one or more additional sleeve sections may be maintained directly or indirectly in a fixed axial position relative to the bearing housing.

As a first non-limiting example, a first sleeve section may be non-rotatably and non-translatably connected directly with the bearing housing, and a second sleeve section adjacent to the first sleeve section, a third sleeve section adjacent to the second sleeve section, and a fourth sleeve section adjacent to the third sleeve section may be non-rotatably interengaged with the first sleeve section and with each other and may be maintained directly or indirectly in a fixed axial position relative to the bearing housing.

As a second non-limiting example, a first sleeve section may be non-rotatably and non-translatably connected directly with the bearing housing, and a second sleeve section adjacent to the first sleeve section, a third sleeve section adjacent to the second sleeve section, a fourth sleeve section adjacent to the third sleeve section, and fifth sleeve section adjacent to the fourth sleeve section may be non-rotatably interengaged with the first sleeve section and with each other and may be maintained directly or indirectly in a fixed axial position relative to the bearing housing.

The bearing assembly is radially interposed between the bearing housing and the driveshaft. The bearing assembly rotatably supports the driveshaft within the bearing housing bore and/or within the sleeve assembly bore.

The bearing assembly may comprise any number of one or more bearings and/or any number of one or more types of bearings. The bearing assembly may comprise one or more thrust bearings for transmitting axial loads between the bearing housing and the driveshaft and/or one or more radial bearings for transmitting radial loads between the bearing housing and the driveshaft. The one or more thrust bearings and/or one or more radial bearings may comprise any suitable type or types of bearing, including as non-limiting examples, plain bearings and rolling element bearings.

The bearing assembly may comprise one or more bearings comprising a stationary bearing component and/or a rotating bearing component.

A stationary bearing component is connected or otherwise engaged directly or indirectly with the bearing housing such that the stationary bearing component is substantially non-rotatable relative to the bearing housing. A stationary bearing component may be connected or otherwise engaged directly with the bearing housing in any suitable manner. As non-limiting examples, a stationary bearing component may be threadably connected with the bearing housing, may be connected with the bearing housing with fasteners, welds or an interference fit, may be engaged with the bearing housing with complementary engagement surfaces, and/or may be integral with the bearing housing.

A rotating bearing component is connected or otherwise engaged directly or indirectly with the driveshaft such that the rotating bearing component is substantially non-rotatable relative to the driveshaft and is rotatable relative to the bearing housing. A rotating bearing component may be connected or otherwise engaged directly with the driveshaft in any suitable manner. As non-limiting examples, a rotating bearing component may be threadably connected with the driveshaft, may be connected with the driveshaft with fasteners, welds or an interference fit, may be engaged with the driveshaft with complementary engagement surfaces, and/or may be integral with the driveshaft.

A stationary bearing component may be indirectly connected or otherwise engaged with the bearing housing by being non-rotatably connected or otherwise engaged with the sleeve assembly, which in turn are non-rotatably connected or otherwise engaged with the bearing housing directly or indirectly.

A single stationary bearing component may be indirectly connected or otherwise engaged with the bearing housing by being non-rotatably connected or otherwise engaged with a single sleeve section in the sleeve assembly, a plurality of stationary bearing components may be indirectly connected or otherwise engaged with the bearing housing by being non-rotatably connected or otherwise engaged with a single sleeve section in the sleeve assembly, or a plurality of stationary bearing components may be indirectly connected or otherwise engaged with the bearing housing by being non-rotatably connected or otherwise engaged with separate sleeve sections in the sleeve assembly.

A stationary bearing component may be non-rotatably connected or otherwise engaged with the sleeve assembly in any suitable manner. As a non-limiting example, a stationary bearing component may be integral with a sleeve section or a sleeve section may comprise a stationary bearing component. As a non-limiting example, a stationary bearing component may be threadably connected with a sleeve section, or may be connected with a sleeve section with fasteners, welds, or an interference fit.

As a further non-limiting example, the sleeve assembly and a stationary bearing component may comprise complementary engagement surfaces and the stationary bearing component may be non-rotatably connected or otherwise engaged with the sleeve assembly by the complementary engagement surfaces. The complementary engagement surfaces may comprise any surfaces which are capable of providing a non-rotatable engagement between the sleeve assembly and the stationary bearing component. As non-limiting examples, the complementary engagement surfaces may comprise interlocking splines, tabs and recesses, lugs and grooves, etc.

The bearing assembly may comprise a first radial bearing comprising a stationary first radial bearing component and a rotating first radial bearing component. The bearing assembly may comprise a second radial bearing comprising a stationary second radial bearing component and a rotating second radial bearing component. The bearing assembly may comprise any number of fewer than two radial bearings or more than two radial bearings.

The first radial bearing may be a distal radial bearing which is located toward the distal end of the bearing housing. The first radial bearing may be a proximal radial bearing which is located toward the proximal end of the bearing housing. The second radial bearing may be a proximal radial bearing which is located toward the proximal end of the bearing housing. The second radial bearing may be a distal radial bearing which is located toward the distal end of the bearing housing.

References in this document to a "first radial bearing" and a "second radial bearing" in association with the radial bearings are intended to differentiate between the radial bearings, and do not indicate any particular order, sequence or position for the radial bearings. In addition, a reference in this document to a "first radial bearing" in association with a radial bearing does not require that there be a "second radial bearing".

The bearing assembly may comprise a first thrust bearing comprising a stationary first thrust bearing component and a rotating first thrust bearing component. The bearing assembly may comprise a second thrust bearing comprising a stationary second thrust bearing component and a rotating second thrust bearing component. The bearing assembly may comprise any number of fewer than two thrust bearings or more than two thrust bearings.

The first thrust bearing may be an on-bottom thrust bearing which transmits compressive axial loads between the driveshaft and the bearing housing. The first thrust bearing may be an off-bottom thrust bearing which transmits tensile axial loads between the driveshaft and the bearing housing. The first thrust bearing may be a combined on-bottom and off-bottom thrust bearing. The second thrust bearing may be an off-bottom thrust bearing which transmits tensile axial loads between the driveshaft and the bearing housing. The second thrust bearing may be an on-bottom thrust bearing which transmits compressive axial loads between the driveshaft and the bearing housing. The second thrust bearing may be a combined on-bottom and off-bottom thrust bearing.

References in this document to a "first thrust bearing" and a "second thrust bearing" in association with the thrust bearings are intended to differentiate between the thrust bearings, and do not indicate any particular order, sequence or position for the thrust bearings. In addition, a reference in this document to a "first thrust bearing" in association with a thrust bearing does not require that there be a "second thrust bearing".

The bearing assembly may comprise a first radial bearing. The first radial bearing may comprise a stationary first radial bearing component. The stationary first radial bearing component may be non-rotatably connected or otherwise engaged with the sleeve assembly. The stationary first radial bearing component may be non-rotatably connected or otherwise engaged with the sleeve assembly by being non-rotatably connected with or by being integral with one or more of the sleeve sections, or one or more of the sleeve sections may comprise the stationary first radial bearing component. The stationary first radial bearing component and the sleeve assembly may comprise complementary engagement surfaces and the stationary first radial bearing component may be non-rotatably connected or otherwise engaged with the sleeve assembly by the complementary engagement surfaces. The first radial bearing may be a distal radial bearing.

The bearing assembly may comprise a first thrust bearing. The first thrust bearing may comprise a stationary first thrust bearing component. The stationary first thrust bearing component may be non-rotatably connected or otherwise engaged with the sleeve assembly. The stationary first thrust bearing component may be non-rotatably connected or otherwise engaged with the sleeve assembly by being non-rotatably connected with or by being integral with one or more of the sleeve sections, or one or more of the sleeve sections may comprise the stationary first thrust bearing component. The stationary first thrust bearing component and the sleeve assembly may comprise complementary engagement surfaces and the stationary first thrust bearing component may be non-rotatably connected or otherwise engaged with the sleeve assembly by the complementary engagement surfaces. The first thrust bearing may be an on-bottom thrust bearing, an off-bottom thrust bearing, or a combined on-bottom and off-bottom thrust bearing.

The bearing assembly may comprise a second radial bearing. The second radial bearing may comprise a stationary second radial bearing component. The stationary second radial bearing component may be non-rotatably connected or otherwise engaged with the sleeve assembly. The stationary second radial bearing component may be non-rotatably connected or otherwise engaged with the sleeve assembly by being non-rotatably connected with or by being integral with one or more of the sleeve sections, or one or more of the sleeve sections may comprise the stationary second radial bearing component. The stationary second radial bearing component and the sleeve assembly may comprise complementary engagement surfaces and the stationary second radial bearing component may be non-rotatably connected or otherwise engaged with the sleeve assembly by the complementary engagement surfaces. The second radial bearing may be a proximal radial bearing.

The bearing assembly may comprise a second thrust bearing. The second thrust bearing may comprise a stationary second thrust bearing component. The stationary second thrust bearing component may be non-rotatably connected or otherwise engaged with the sleeve assembly. The stationary second thrust bearing component may be non-rotatably connected or otherwise engaged with the sleeve assembly by being non-rotatably connected with or by being integral with one or more of the sleeve sections, or one or more of the sleeve sections may comprise the stationary second thrust bearing component. The stationary second thrust bearing component and the sleeve assembly may comprise complementary engagement surfaces and the stationary second thrust bearing component may be non-rotatably connected or otherwise engaged with the sleeve assembly by the complementary engagement surfaces. The second thrust bearing may be an off-bottom thrust bearing, an on-bottom thrust bearing, or a combined off-bottom and on-bottom thrust bearing.

FIGS. 1-29 depict non-limiting embodiments of a drilling apparatus, wherein the drilling apparatus comprises a drive section and a bearing section.

More particularly, FIG. 1 depicts an exemplary drilling apparatus, including a drive section, a transmission section, and a bearing section.

Figure 2:
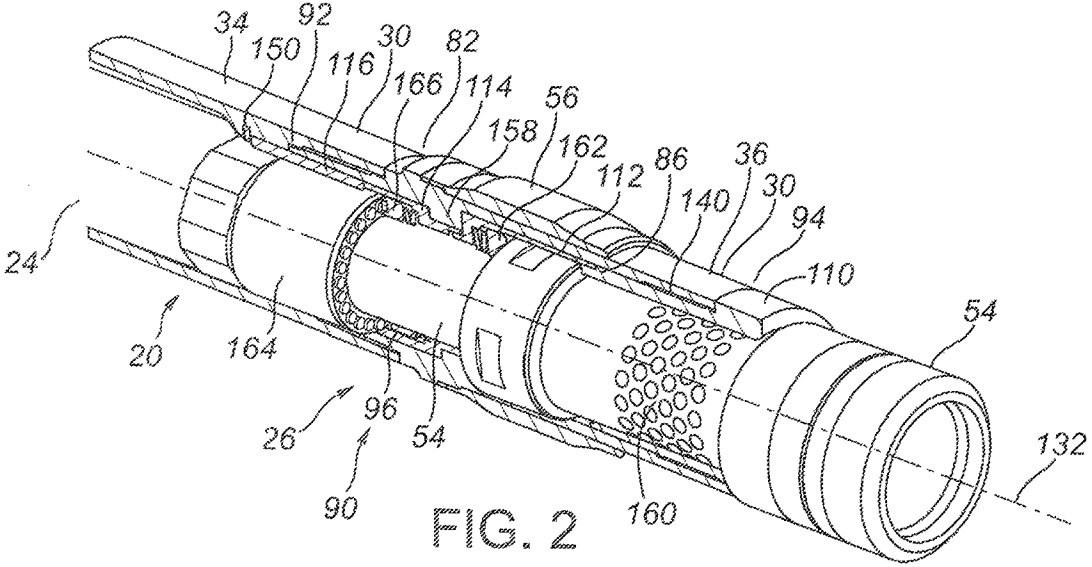
FIG. 2 is a partial cutaway pictorial view of a bearing section in a first exemplary embodiment of a drilling apparatus.
Figure 3:
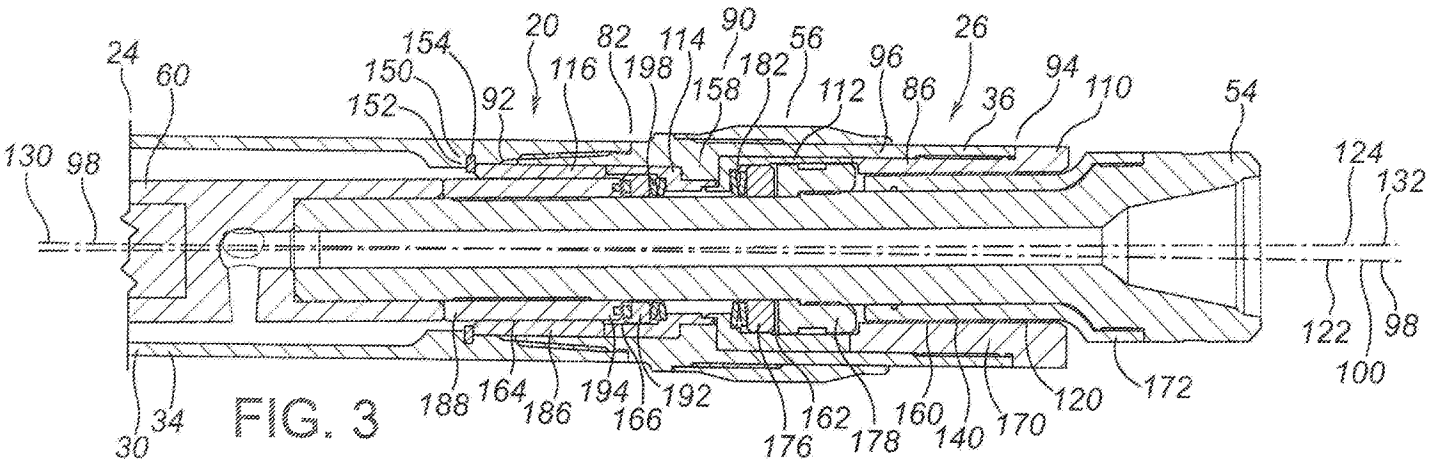
FIG. 3 is a longitudinal section assembly view of the bearing section depicted in FIG. 2.
Figure 4:
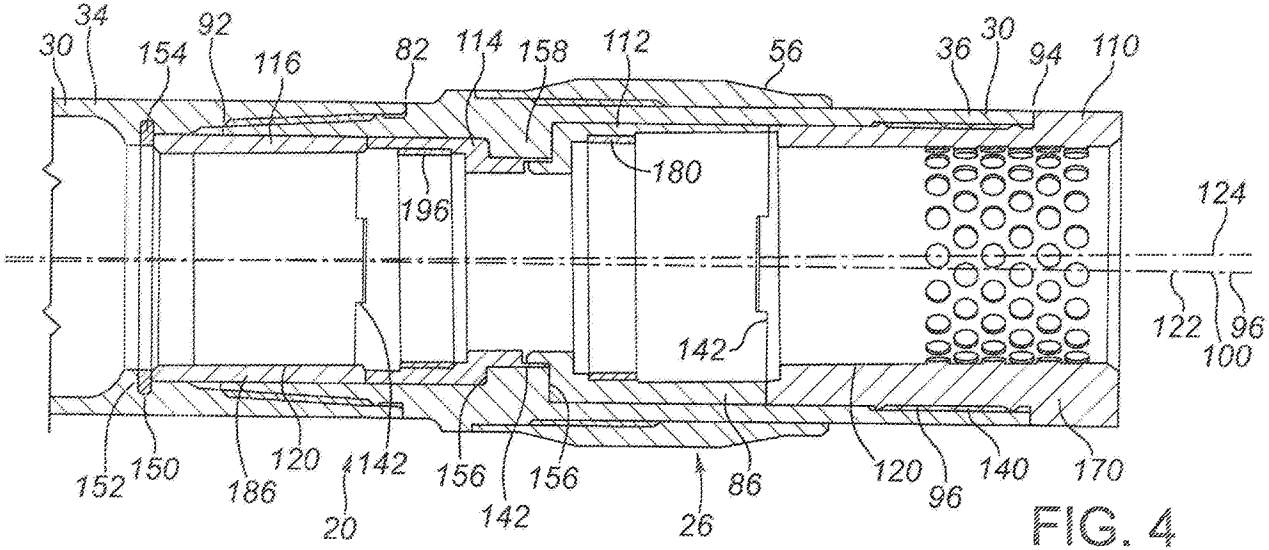
FIG. 4 is a cutaway view of selected assembled components of the bearing section depicted in FIG. 2.
Figure 5B:
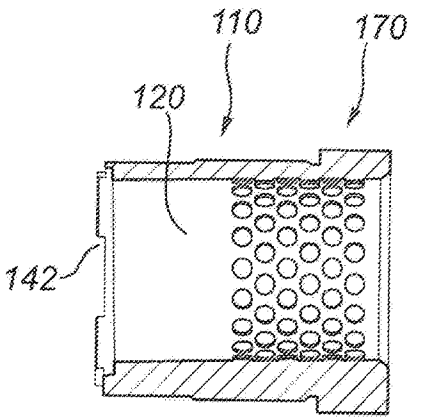
FIGS. 5A and 5B are a pictorial view and a longitudinal section view respectively of a first sleeve section in the bearing section depicted in FIG. 2, including a stationary first radial bearing component.
Figure 5A:
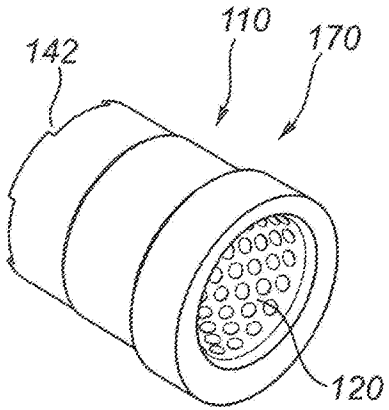
Figure 6B:
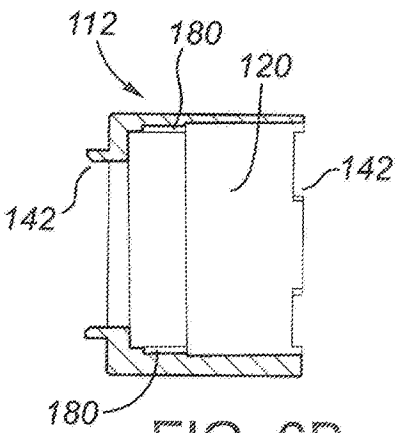
FIGS. 6A and 6B are a pictorial view and a longitudinal section view respectively of a second sleeve section in the bearing section depicted in FIG. 2.
Figure 6A:
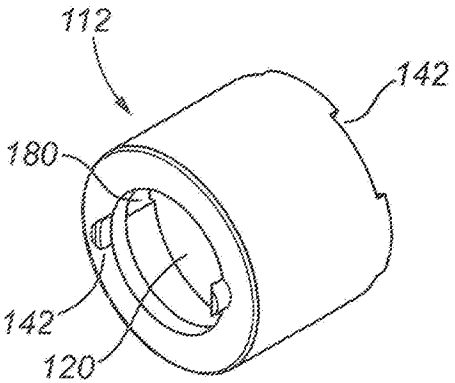
Figure 7A:
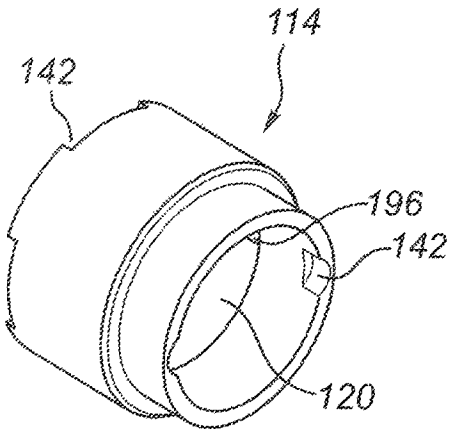
FIGS. 7A and 7B are a pictorial view and a longitudinal section view respectively of a third sleeve section in the bearing section depicted in FIG. 2.
Figure 7B:
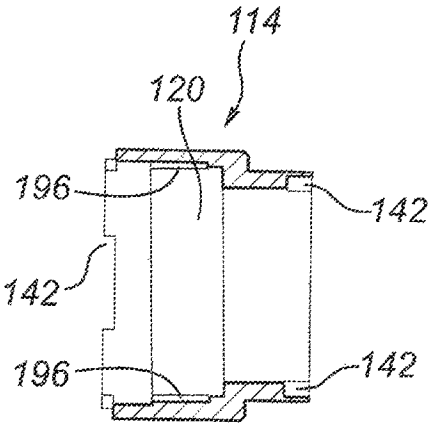
Figure 8A:
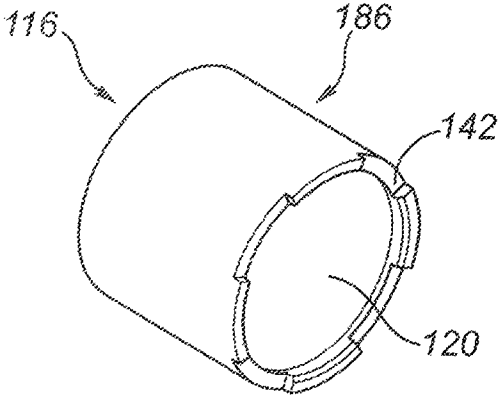
FIGS. 8A and 8B are a pictorial view and a longitudinal section view respectively of a fourth sleeve section in the bearing section depicted in FIG. 2, including a stationary second radial bearing component.
Figure 8B:
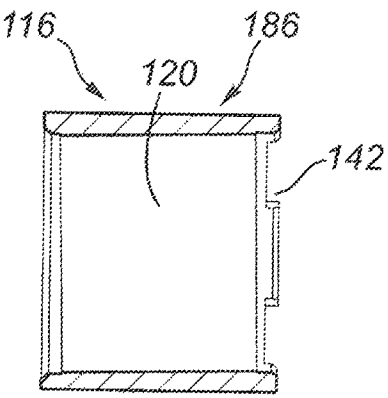
Figure 9B:
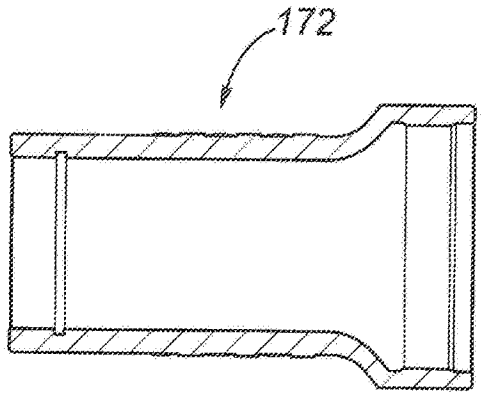
FIGS. 9A and 9B are a pictorial view and a longitudinal section view respectively of a rotating first radial bearing component in the bearing section depicted in FIG. 2.
Figure 11:
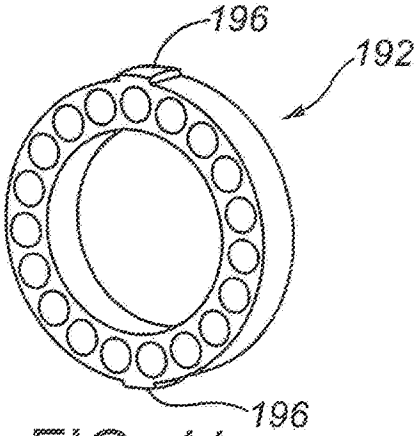
FIG. 11 is a pictorial view of a stationary second thrust bearing component in the bearing section depicted in FIG. 2.
Figure 9A:
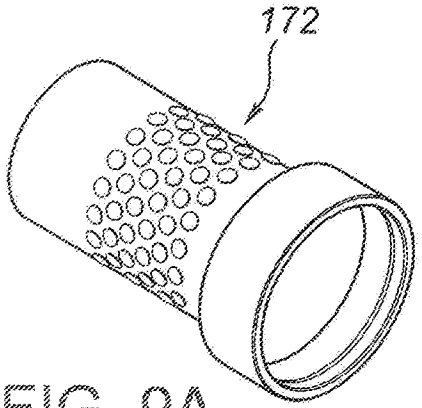
Figure 10:
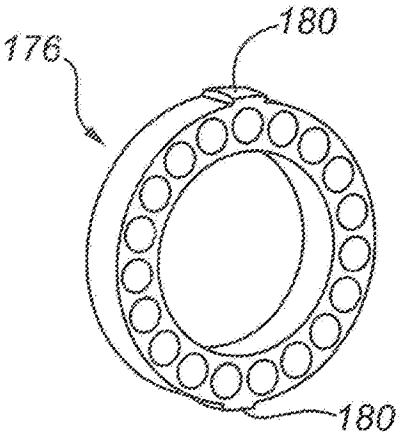
FIG. 10 is a pictorial view of a stationary first thrust bearing component in the bearing section depicted in FIG. 2.
Figure 13:
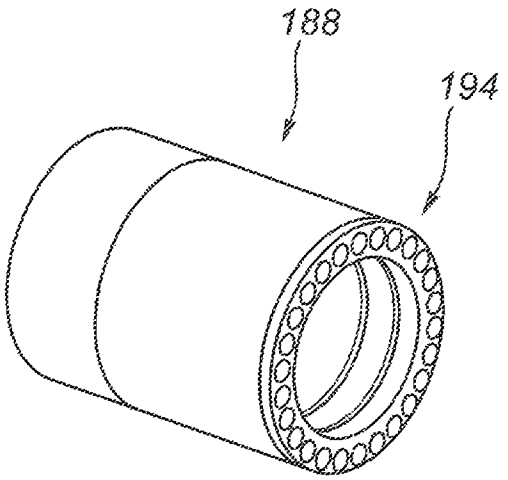
FIG. 13 is a pictorial view of a rotating second radial bearing component and a rotating second thrust bearing component in the bearing section depicted in FIG. 2.
Figure 12:
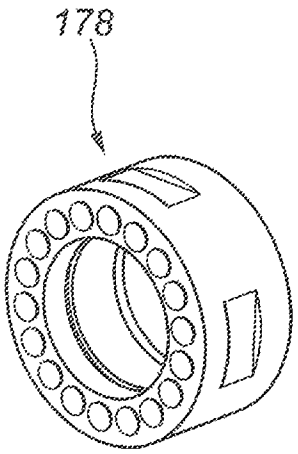
FIG. 12 is a pictorial view of a rotating first thrust bearing component in the bearing section depicted in FIG. 2.

FIG. 2 pictorially depicts a bearing section in a first exemplary embodiment of a drilling apparatus of the type depicted in FIG. 1. FIG. 3 depicts as a longitudinal section assembly view the bearing section in the first exemplary embodiment of FIG. 2. FIG. 4 depicts selected assembled components of the bearing section in the first exemplary embodiment of FIG. 2. FIGS. 5-13 depict individual components of the bearing section in the first exemplary embodiment of FIG. 2. FIGS. 14A-14D depict an exemplary sequence for assembling the bearing section in the first exemplary embodiment of FIG. 2.

Figure 15:
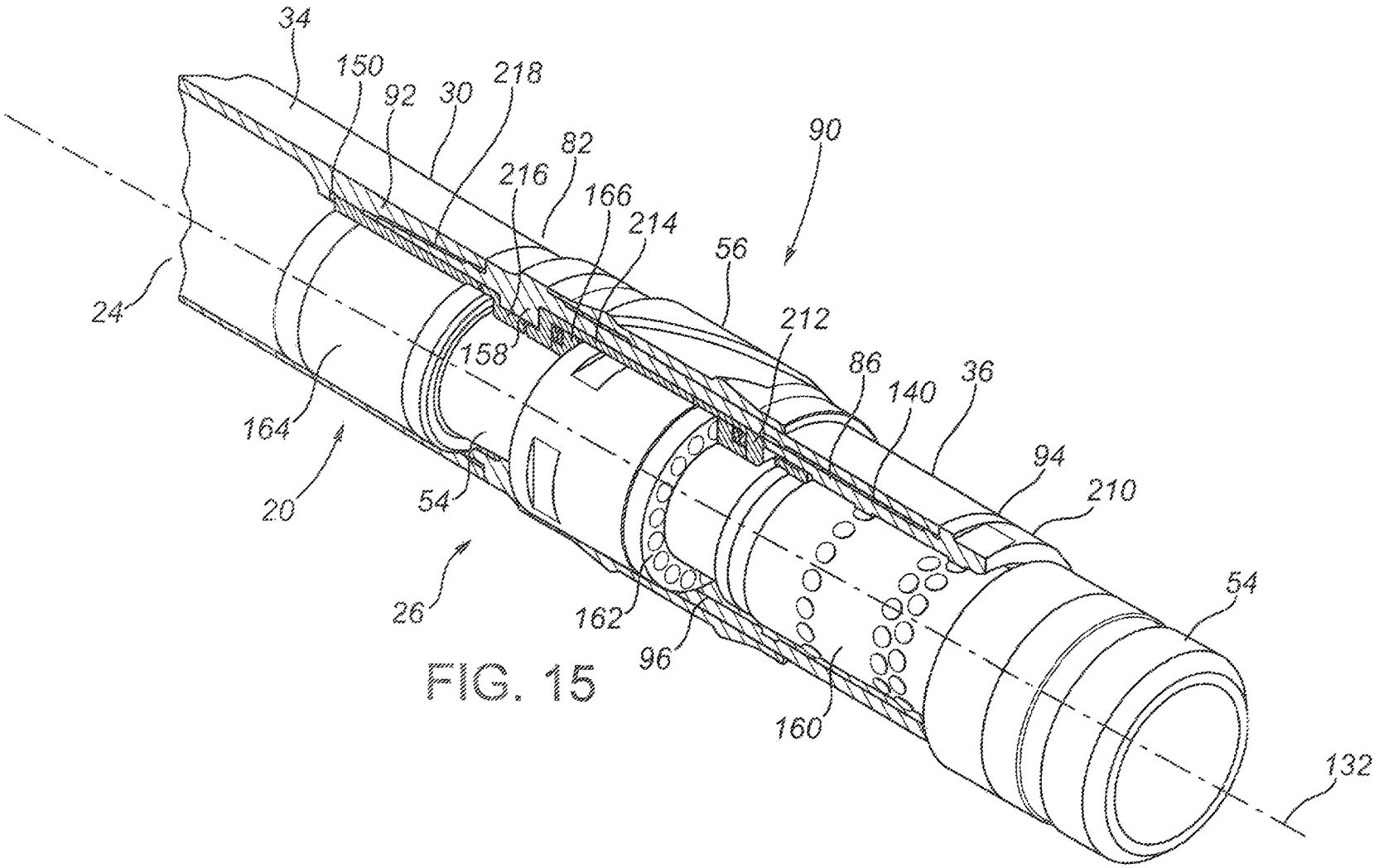
FIG. 15 is a partial cutaway pictorial view of a bearing section in a second exemplary embodiment of a drilling apparatus.
Figure 16:
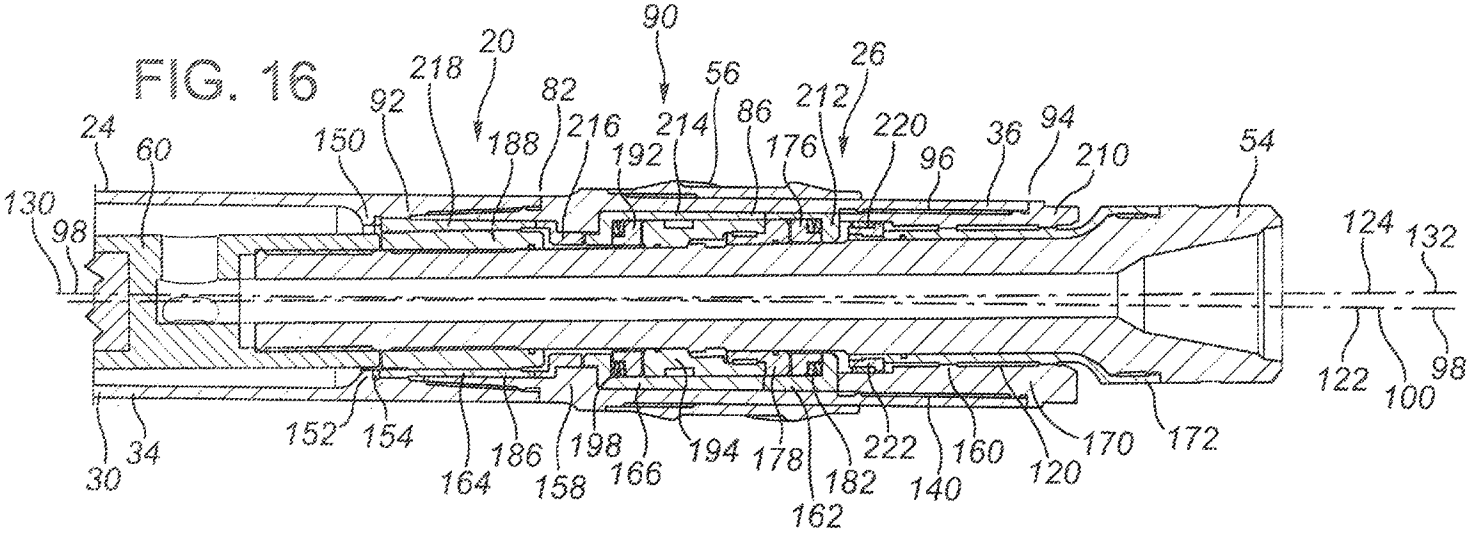
FIG. 16 is a longitudinal section assembly view of the bearing section depicted in FIG. 15.
Figure 17:
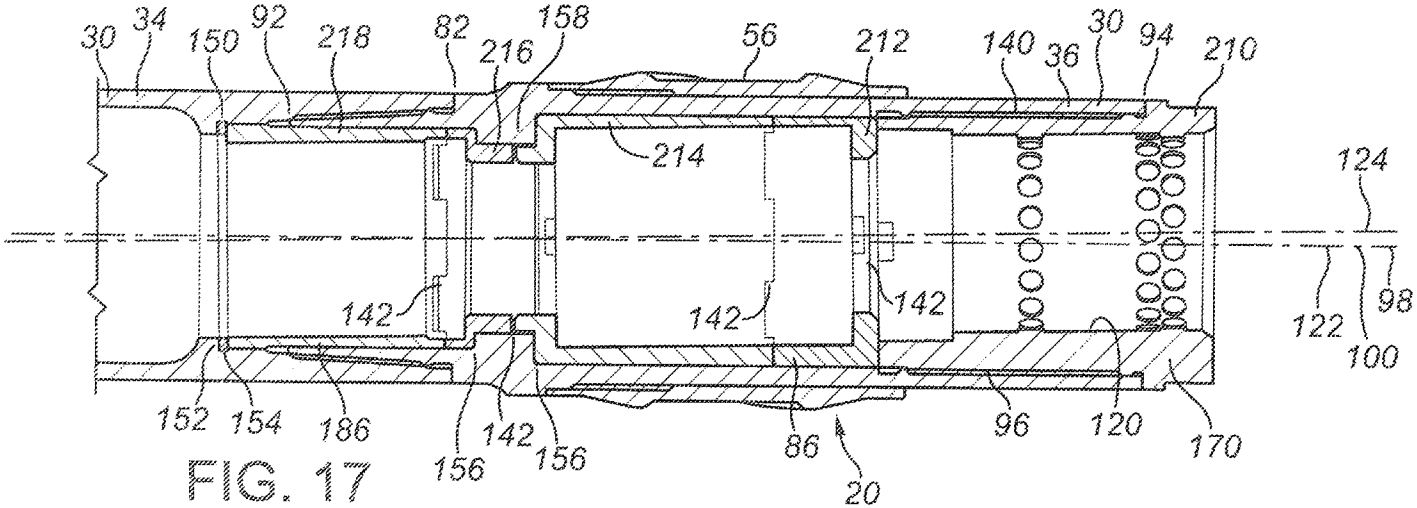
FIG. 17 is a cutaway view of selected assembled components of the bearing section depicted in FIG. 15.
Figure 18A:
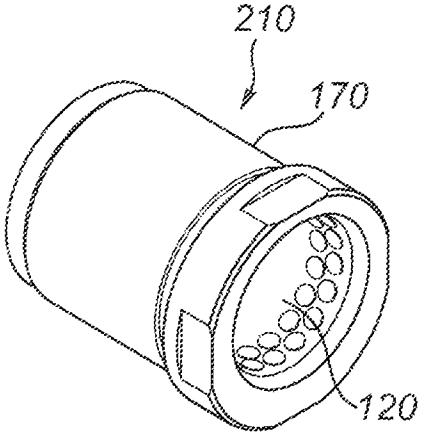
FIGS. 18A and 18B are a pictorial view and a longitudinal section view respectively of a first sleeve section in the bearing section depicted in FIG. 15, including a stationary first radial bearing component.
Figure 18B:
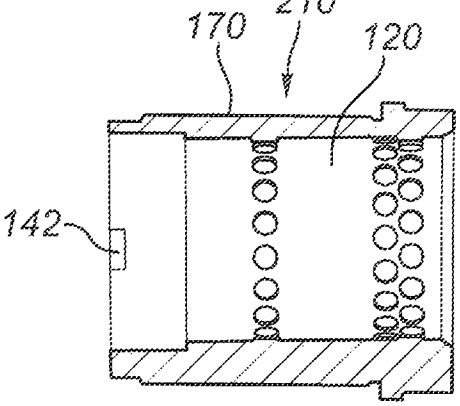
Figure 19A:
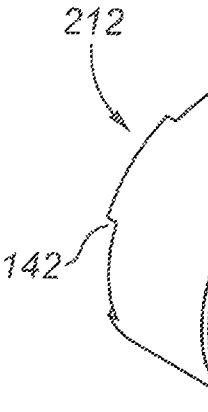
FIGS. 19A and 19B are a pictorial view and a longitudinal section view respectively of a second sleeve section in the bearing section depicted in FIG. 15.
Figure 19B:
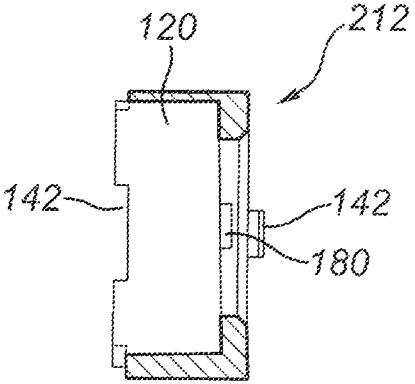
Figure 20B:
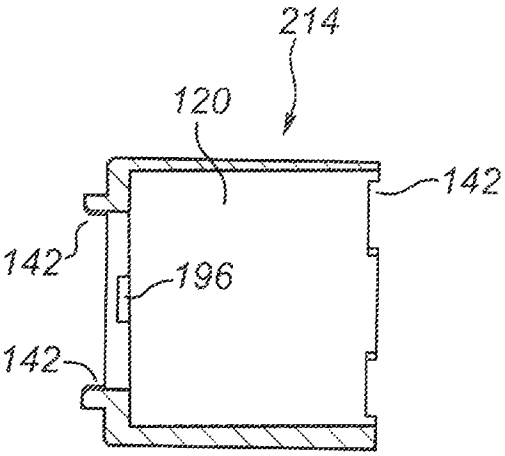
FIGS. 20A and 20B are a pictorial view and a longitudinal section view respectively of a third sleeve section in the bearing section depicted in FIG. 15.
Figure 21B:
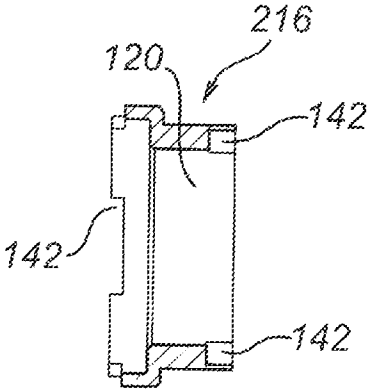
FIGS. 21A and 21B are a pictorial view and a longitudinal section view respectively of a fourth sleeve section in the bearing section depicted in FIG. 15.
Figure 20A:
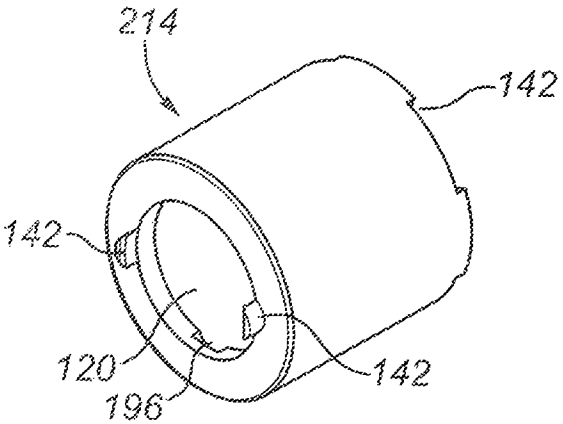
Figure 21A:
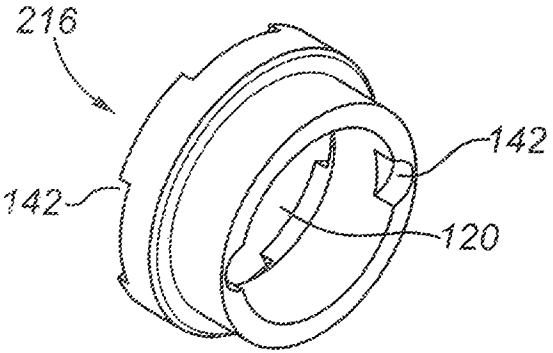
Figure 22A:
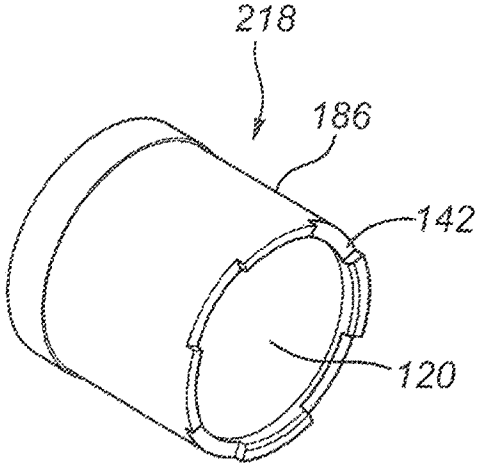
FIGS. 22A and 22B are a pictorial view and a longitudinal section view respectively of a fifth sleeve section in the bearing section depicted in FIG. 15, including a stationary second radial bearing component.
Figure 22B:
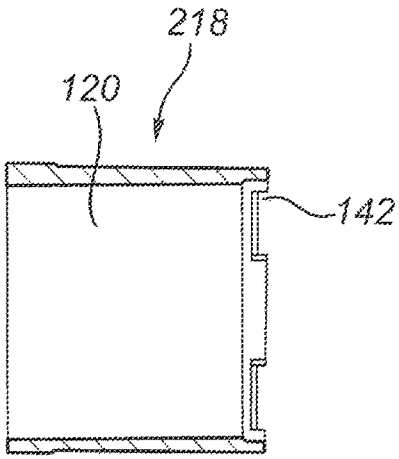
Figure 23A:
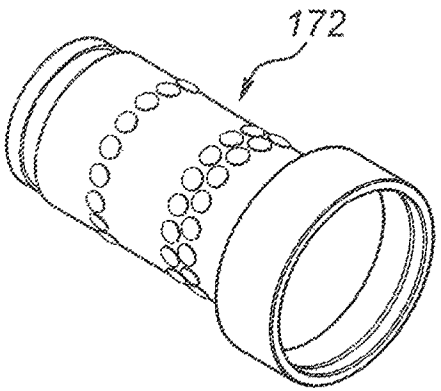
FIGS. 23A and 23B are a pictorial view and a longitudinal section view respectively of a rotating first radial bearing component in the bearing section depicted in FIG. 15.
Figure 23B:
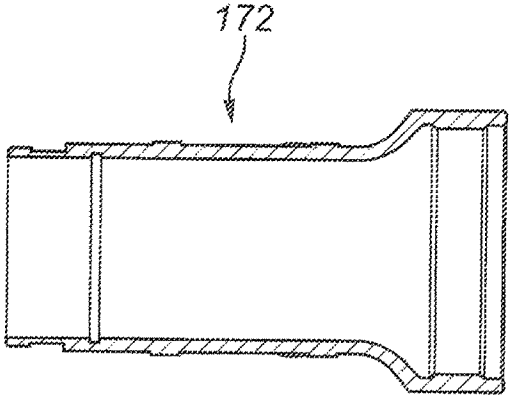
Figure 24B:
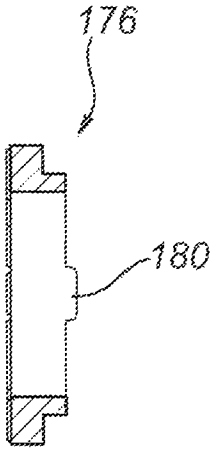
FIGS. 24A and 24B are a pictorial view and a longitudinal section view respectively of a stationary first thrust bearing component in the bearing section depicted in FIG. 15.
Figure 25B:
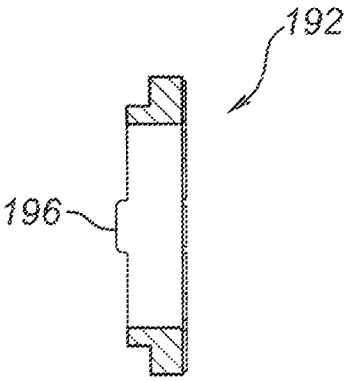
FIGS. 25A and 25B are a pictorial view and a longitudinal section view respectively of a stationary second thrust bearing component in the bearing section depicted in FIG. 15.
Figure 24A:
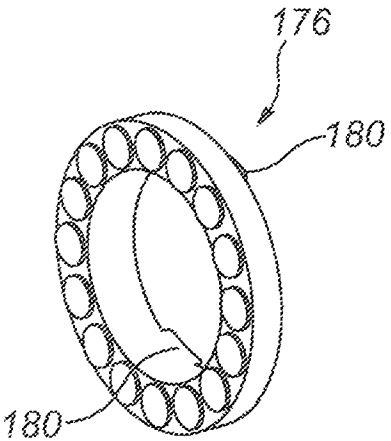
Figure 25A:
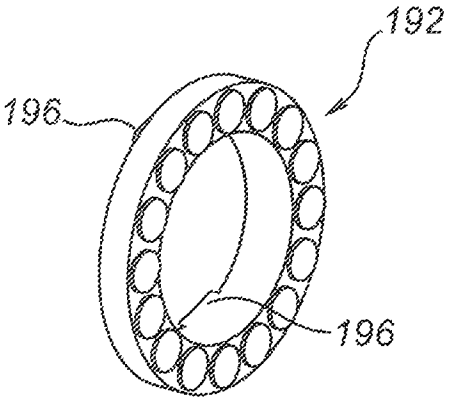
Figure 27:
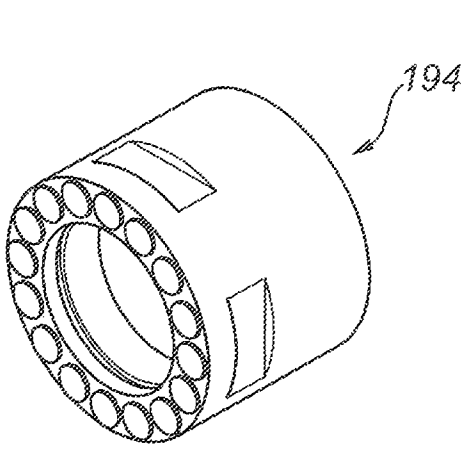
FIG. 27 is a pictorial view of a rotating second thrust bearing component in the bearing section depicted in FIG. 15.
Figure 26:
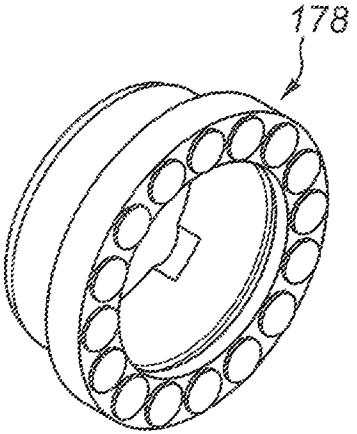
FIG. 26 is a pictorial view of a rotating first thrust bearing component in the bearing section depicted in FIG. 15.
Figure 28:
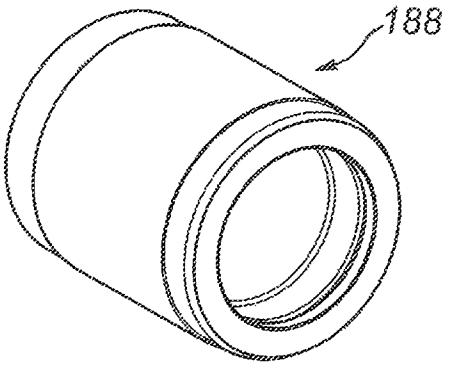
FIG. 28 is a pictorial view of a rotating second radial bearing component in the bearing section depicted in FIG. 15.

FIG. 15 pictorially depicts a bearing section in a second exemplary embodiment of a drilling apparatus of the type depicted in FIG. 1. FIG. 16 depicts as a longitudinal section assembly view the bearing section in the second exemplary embodiment of FIG. 15. FIG. 17 depicts selected assembled components of the bearing section in the second exemplary embodiment of FIG. 15. FIGS. 18-28 depict individual components of the bearing section in the second exemplary embodiment of FIG. 15. FIGS. 29A-29D depict an exemplary sequence for assembling the bearing section in the second exemplary embodiment of FIG. 15.

FIGS. 1-29 are exemplary only. The features of the drilling apparatus depicted in FIGS. 1-29 and described herein may be included in alternate designs and types of drilling apparatus in addition to the exemplary drilling apparatus of FIG. 1, the first exemplary embodiment of FIGS. 2-14, and the second exemplary embodiment of FIGS. 15-29.

In the description of the exemplary drilling apparatus, the first exemplary embodiment, and the second exemplary embodiment which follows, features of the invention which are identical or equivalent in the exemplary drilling apparatus and the exemplary embodiments will be identified with the same reference numbers.

Referring to FIG. 1, the exemplary drilling apparatus (20) described herein comprise a drilling motor. Referring to FIG. 1, the drilling motor comprises a plurality of sections as depicted in FIG. 1. The drilling motor may comprise additional sections which are not depicted in FIG. 1.

Referring to FIG. 1, the drilling motor comprises a drive section or power section (22) and a bearing section (26). The bearing section (26) is axially distal to the power section (22). One or more sections of the drilling motor may be axially interposed between the power section (22) and the bearing section (26). As depicted in FIG. 1, the drilling motor further comprises a transmission section (24) which is axially interposed between the power section (22) and the bearing section (26). These sections of the drilling motor constitute components of a powertrain which utilizes fluid energy to rotate a drill bit (28).

The sections of the drilling motor are contained within a tubular housing (30).

As depicted in FIG. 1, the housing (30) comprises a plurality of housing sections connected together with threaded connections, including a tubular drive housing or power housing (32) for the power section (22), a tubular transmission housing (34) for the transmission section (24), and a tubular bearing housing (36) for the bearing section (26).

The power housing (32) may comprise a plurality of power housing components which together provide the power housing (32), or the power housing (32) may be a unitary power housing (32) which is formed from a single drive housing component.

The transmission housing (34) may comprise a plurality of transmission housing components which together provide the transmission housing (34), or the transmission housing (34) may be a unitary transmission housing (34) which is formed from a single transmission housing component.

The bearing housing (36) may comprise a plurality of bearing housing components which together provide the bearing housing (36), or the bearing housing (36) may be a unitary bearing housing (36) which is formed from a single bearing housing component.

The power section (22) of the drilling motor comprises a stator (50) and a drive member or rotor (52). The stator (50) is fixedly connected with the power housing (32), and the rotor (52) is rotatable within the stator (50) in response to fluid circulating through the power section (22).

As depicted in FIG. 1, the power section (22) is a Moineau-type power section in which the stator (50) and the rotor (52) are lobed. The rotor (52) has one fewer lobe than the stator (50), and rotates eccentrically within the stator (50).

The transmission section (24) accommodates and converts the eccentric movement of the rotor (52) to concentric rotation of a driveshaft (54) within the bearing section (26). The transmission section (24) also transmits rotational drive energy from the power section (22) to the bearing section (26).

As depicted in FIG. 1, the transmission section (24) comprises the transmission housing (34) and a transmission member or transmission shaft (60) which is connected between the rotor (52) and the driveshaft (54) so that rotation of the rotor (52) causes rotation of the transmission shaft (60), and rotation of the transmission shaft (60) causes rotation of the driveshaft (54).

As depicted in FIG. 1, the bearing section (26) comprises the bearing housing (36), the driveshaft (44) and a bearing assembly (not shown in FIG. 1) which rotatably supports the driveshaft (54) within the bearing housing bore (42). As depicted in FIG. 1, the bearing section (26) also comprises a stabilizer (56) which is threadably connected with the exterior of the bearing housing (36).

As depicted in FIG. 1, the drill bit (28) is connected with the driveshaft (54) so that rotation of the driveshaft (54) causes rotation of the drill bit (28).

Referring now to FIG. 1 with FIGS. 2-14, features of the first exemplary embodiment of the drilling apparatus (20) are described in further detail.

Referring to FIG. 1, the first exemplary embodiment of the drilling apparatus (20) comprises the drive section or power section (22), the transmission section (24), and the bearing section (26). The bearing section (26) is axially distal to the power section (22).

Referring to FIG. 1, in the first exemplary embodiment, the power section (22) comprises the drive or power housing (32), the stator (50), and the drive member or rotor (52). The power housing (32) has a proximal power housing end (70) and a distal power housing end (72).

Referring to FIG. 1, in the first exemplary embodiment, the transmission section (24) comprises the transmission housing (34) and the transmission member or transmission shaft (60). The transmission housing (34) has a proximal transmission housing end (80) and a distal transmission housing end (82).

Referring to FIGS. 2-3, in the first exemplary embodiment, the bearing section (26) comprises the bearing housing (36), the driveshaft (54), a sleeve assembly (86), and a bearing assembly (90).

The bearing housing (36) has a proximal bearing housing end (92), a distal bearing housing end (94), and defines a bearing housing bore (96). The bearing housing (36) has a bearing housing axis (98) which is defined by the exterior of the bearing housing (36), and a bearing housing bore axis (100) which is defined by the bearing housing bore (96). In the first exemplary embodiment, the bearing housing axis (98) is substantially parallel with the bearing housing bore axis (100). In the first exemplary embodiment, the bearing housing (36) is a unitary bearing housing (36) which is formed from a single bearing housing component.

In the first exemplary embodiment, the transmission section (24) is the only section of the drilling apparatus (20) which is axially interposed between the power section (22) and the bearing section (26). More particularly, the transmission housing (34) is connected directly with both the power housing (32) and the bearing housing (36). As a result, in the exemplary embodiment, the distal power housing end (72) is connected directly with the proximal transmission housing end (80), and the distal transmission housing end (82) is connected directly with the proximal bearing housing end (92). In the exemplary embodiment, the transmission shaft (60) is connected between the rotor (52) and the driveshaft (54).

The sleeve assembly (86) is received within the bearing housing bore (96). In the first exemplary embodiment, the sleeve assembly (86) comprises a plurality of sleeve sections, consisting of a first sleeve section (110), a second sleeve section (112), a third sleeve section (114), and a fourth sleeve section (116).

The sleeve sections (110, 112, 114, 116) are axially arranged within the bearing housing bore (96). In the first exemplary embodiment, the sleeve sections (110, 112, 114, 116) are axially arranged within the bearing housing bore (96) end-to-end such that the ends of adjacent sleeve sections (110, 112, 114, 116) contact each other.

The sleeve assembly (86) defines a sleeve assembly bore (120). The sleeve assembly has a sleeve assembly axis (122) which is defined by the exterior of the sleeve assembly (86), and a sleeve assembly bore axis (124) which is defined by the sleeve assembly bore (120). In the first exemplary embodiment, the sleeve assembly bore axis (124) is oblique (i.e., non-parallel) to the sleeve assembly axis (122). In the first exemplary embodiment, the sleeve assembly axis (122) is substantially parallel with both the bearing housing bore axis (100) and the bearing housing axis (98). As a result, in the first exemplary embodiment, the sleeve assembly bore axis (124) is oblique to both the bearing housing axis (98) and the bearing housing bore axis (100).

Referring to FIG. 1 and FIG. 3, the drilling apparatus (20) has a primary axis (130). In the first exemplary embodiment, the primary axis (130) is the axis of the power section (22) and the transmission section (24) of the drilling apparatus (20).

In the first exemplary embodiment, the bearing housing axis (98) is substantially parallel with the primary axis (130). In other embodiments, the bearing housing axis (98) may be oblique to the primary axis (130).

In the first exemplary embodiment, the driveshaft (54) is received within the sleeve assembly bore (120) and is rotatable relative to the bearing housing (36).

Referring to FIG. 1 and FIG. 3, the driveshaft (54) has a driveshaft axis (132). The driveshaft axis (132) is the axis of rotation of the driveshaft (54) within the bearing housing (36).

In the first exemplary embodiment, the driveshaft axis (132) coincides with and is parallel with the sleeve assembly bore axis (124), since the driveshaft (54) is received within the sleeve assembly bore (120). Consequently, in the first exemplary embodiment, the driveshaft axis (132) is oblique to the primary axis (130) of the drilling apparatus (20), to the bearing housing bore axis (100), and to the bearing housing axis (98).

As a result, in the first exemplary embodiment, the tilting of the driveshaft axis (132) relative to the primary axis (130) which is provided by the sleeve assembly (86) constitutes an angular offset within the bearing section (36) of the drilling apparatus (20), which may render the drilling apparatus (20) suitable for directional drilling.

Referring to FIGS. 2-4 and FIG. 5, in the first exemplary embodiment, the first sleeve section (110) is threadably connected with the bearing housing (36) by a threaded sleeve connection (140) between the first sleeve section (110) and the bearing housing (36) adjacent to the distal bearing housing end (94). The sleeve connection (140) when tightened non-rotatably and non-translatably connects the first sleeve section (110) with the bearing housing (36) and enables the first sleeve section (110) to maintain a fixed angular position and a fixed axial position relative to the bearing housing (36).

Referring to FIGS. 2-4 and FIGS. 5-8, in the first exemplary embodiment, the first sleeve section (110), the second sleeve section (112), the third sleeve section (114), and the fourth sleeve section (116) are non-rotatably interengaged with each other so that the sleeve sections maintain a fixed angular position relative to each other. Since the first sleeve section (110) is non-rotatably connected with the bearing housing (36), all of the sleeve sections (110, 112, 114, 116) are non-rotatably connected or otherwise engaged with the bearing housing (36) and maintain a fixed angular position relative to the bearing housing (36) following assembly of the drilling apparatus (20).

In the first exemplary embodiment, the non-rotatable interengagement of the sleeve sections (110, 112, 114, 116) is achieved by complementary engagement surfaces (142) on the sleeve sections (110, 112, 114, 116).

Referring to FIGS. 2-4 and FIGS. 5-6, the first sleeve section (110) and the second sleeve section (112) constitute a pair of adjacent sleeve sections which have adjacent ends in contact with each other. In the first exemplary embodiment, the complementary engagement surfaces (142) between the first sleeve section (110) and the second sleeve section (112) comprise an arrangement of interlocking tabs and recesses at the adjacent ends of the first sleeve section (110) and the second sleeve section (112).

Referring to FIGS. 2-4 and FIGS. 6-7, the second sleeve section (112) and the third sleeve section (114) constitute a pair of adjacent sleeve sections which have adjacent ends in contact with each other. In the first exemplary embodiment, the complementary engagement surfaces (142) between the second sleeve section (112) and the third sleeve section (114) comprise an arrangement of interlocking tabs and recesses at the adjacent ends of the second sleeve section (112) and the third sleeve section (114). In the first exemplary embodiment, the tabs and recesses on the adjacent ends of the second sleeve section (112) and the third sleeve section (114) are different from the tabs and recesses on the adjacent ends of the first sleeve section (110) and the second sleeve section (112).

Referring to FIGS. 2-4 and FIGS. 7-8, the third sleeve section (114) and the fourth sleeve section (116) constitute a pair of adjacent sleeve sections which have adjacent ends in contact with each other. In the first exemplary embodiment, the complementary engagement surfaces (142) between the third sleeve section (114) and the fourth sleeve section (116) comprise an arrangement of interlocking tabs and recesses at the adjacent ends of the third sleeve section (114) and the fourth sleeve section (116). In the first exemplary embodiment, the tabs and recesses on the adjacent ends of the third sleeve section (114) and the fourth sleeve section (116) are similar to the tabs and recesses on the adjacent ends of the first sleeve section (110) and the second sleeve section (112).

Referring to FIGS. 2-4, in the first exemplary embodiment, the sleeve sections (110, 112, 114, 116) are retained within the bearing housing bore (96) such that each of the sleeve sections (110, 112, 114, 116) maintains a fixed axial position relative to the bearing housing (36).

In the first exemplary embodiment, the drilling apparatus (20) comprises a retaining shoulder (150) extending radially into the bearing housing bore (96) adjacent to the proximal bearing housing end (92). In the first exemplary embodiment, the retaining shoulder (150) comprises a discontinuity (152) within the interior of the transmission housing (34) and a spacer (154) which abuts the discontinuity (152) and is received within a groove adjacent to the discontinuity (152). In the first exemplary embodiment, the spacer (154) is constructed of a relatively flexible and/or deformable material such as Teflon™ or rubber.

The retaining shoulder (150) limits the movement of the sleeve assembly (86) proximally within the bearing housing bore (96), and the sleeve connection (140) limits the movement of the sleeve assembly (86) distally within the bearing housing bore (96), with the result that the sleeve sections (110, 112, 114, 116) are retained within the bearing housing bore (96) between the retaining shoulder (150) and the sleeve connection (140) and maintain a fixed axial position relative to the bearing housing (36).

In the first exemplary embodiment, complementary engagement surfaces (156) comprising an internal shoulder (158) in the bearing housing (36) and corresponding shoulders in the second sleeve section (112) and the third sleeve section (114) are provided. The complementary engagement surfaces (156) assist in maintaining the second sleeve section (112) and the third sleeve section (114) in a fixed axial position relative to the bearing housing (36).

The bearing assembly (90) is radially interposed between the bearing housing (36) and the driveshaft (54) and rotatably supports the driveshaft (54) within the sleeve assembly bore (120).

Referring to FIGS. 2-5 and FIGS. 8-13, components of the bearing assembly (90) in the bearing section (26) of the first exemplary embodiment of the drilling apparatus (20) are depicted.

In the first exemplary embodiment, the bearing assembly (90) comprises a first radial bearing (160), a first thrust bearing (162), a second radial bearing (164), and a second thrust bearing (166).

Referring to FIGS. 2-4, FIG. 5 and FIG. 9, in the first exemplary embodiment, the first radial bearing (160) comprises a stationary first radial bearing component (170) and a rotating first radial bearing component (172). In the first exemplary embodiment, the first radial bearing (160) is a plain bearing in which the bearing surfaces between the first radial bearing components (170, 172) comprise wear resistant inserts such as polycrystalline diamond (PDC) inserts. In the first exemplary embodiment, the stationary first radial bearing component (170) is integral with the first sleeve section (110) so that the first sleeve section (110) comprises the stationary first radial bearing component (170), and the rotating first radial bearing component (172) is threadably connected with the driveshaft (54). As a result, the stationary first radial bearing component (170) is non-rotatably connected or otherwise engaged with the sleeve assembly (86) and the rotating first radial bearing component (172) is non-rotatably connected or otherwise engaged with the driveshaft (54).

Referring to FIGS. 2-4, FIG. 10 and FIG. 12, in the first exemplary embodiment, the first thrust bearing (162) comprises a stationary first thrust bearing component (176) and a rotating first thrust bearing component (178). In the first exemplary embodiment, the first thrust bearing (162) is a plain bearing in which the bearing surfaces between the first thrust bearing components (176, 178) comprise wear resistant inserts such as PDC inserts. In the first exemplary embodiment, the stationary first thrust bearing component (176) is non-rotatably connected with the second sleeve section (112) by complementary engagement surfaces (180) on the stationary first thrust bearing component (176) and the second sleeve section (112). In the first exemplary embodiment, the complementary engagement surfaces (180) comprise tabs on the stationary first thrust bearing component (176) and recesses in the second sleeve section (112). In the first exemplary embodiment, the rotating first thrust bearing component (178) is threadably connected with the driveshaft (54). As a result, the stationary first thrust bearing component (176) is non-rotatably connected or otherwise engaged with the sleeve assembly (86) and the rotating first thrust bearing component (178) is non-rotatably connected or otherwise engaged with the driveshaft (54).

The first thrust bearing (162) may or may not be preloaded so that the stationary first thrust bearing component (176) and the rotating first thrust bearing component (178) are urged into engagement with each other. If the first thrust bearing (162) is preloaded, the first thrust bearing (162) may be preloaded in any suitable manner. As a first non-limiting example, the first thrust bearing (162) may be preloaded by a resilient material such as a rubber or an elastomer, which may be provided as one or more suitable O-rings or in any other suitable form. As a second non-limiting example, the first thrust bearing (162) may be preloaded by a resilient structure or device such as one or more suitable springs, which may be provided as coil springs, Belleville springs, or as any other suitable type of spring.

In the first exemplary embodiment, the first thrust bearing (162) is preloaded with springs (182) which are interposed between the shoulder in the second sleeve section (112) and the stationary first thrust bearing component (176) and which urge the stationary first thrust bearing component (176) into engagement with the rotating first thrust bearing component (178). In the first exemplary embodiment, the first thrust bearing (162) is an on-bottom thrust bearing.

Referring to FIGS. 2-4, FIG. 8 and FIG. 13, in the first exemplary embodiment, the second radial bearing (164) comprises a stationary second radial bearing component (186) and a rotating second radial bearing component (188). In the first exemplary embodiment, the second radial bearing (164) is a plain bearing in which the bearing surfaces between the second radial bearing components (186, 188) comprise a wear resistant material such as a thermally sprayed wear resistant material. In the first exemplary embodiment, the stationary second radial bearing component (170) is integral with the fourth sleeve section (116) so that the second sleeve section (116) comprises the stationary second radial bearing component (186), and the rotating second radial bearing component (188) is threadably connected with the driveshaft (54). As a result, the stationary second radial bearing component (186) is non-rotatably connected or otherwise engaged with the sleeve assembly (86) and the rotating second radial bearing component (188) is non-rotatably connected or otherwise engaged with the driveshaft (54).

Referring to FIGS. 2-4, FIG. 11 and FIG. 13, in the first exemplary embodiment, the second thrust bearing (166) comprises a stationary second thrust bearing component (192) and a rotating second thrust bearing component (194). In the first exemplary embodiment, the second thrust bearing (166) is a plain bearing in which the bearing surfaces between the second thrust bearing components (192, 194) comprise wear resistant inserts such as PDC inserts. In the first exemplary embodiment, the stationary second thrust bearing component (192) is non-rotatably connected with the third sleeve section (114) by complementary engagement surfaces (196) on the stationary second thrust bearing component (192) and the third sleeve section (114). In the first exemplary embodiment, the complementary engagement surfaces (196) comprise tabs on the stationary second thrust bearing component (192) and recesses in the third sleeve section (114). In the first exemplary embodiment, the rotating second thrust bearing component (194) is combined with the rotating second radial bearing component (188) as a single part and is threadably connected with the driveshaft (54). As a result, the stationary second thrust bearing component (192) is non-rotatably connected or otherwise engaged with the sleeve assembly (86) and the rotating second thrust bearing component (194) is non-rotatably connected or otherwise engaged with the driveshaft (54).

The second thrust bearing (166) may or may not be preloaded so that the stationary second thrust bearing component (192) and the rotating second thrust bearing component (194) are urged into engagement with each other. If the second thrust bearing (166) is preloaded, the second thrust bearing (166) may be preloaded in any suitable manner. As a first non-limiting example, the second thrust bearing (166) may be preloaded by a resilient material such as a rubber or an elastomer, which may be provided as one or more suitable O-rings or in any other suitable form. As a second non-limiting example, the second thrust bearing (166) may be preloaded by a resilient structure or device such as one or more suitable springs, which may be provided as coil springs, Belleville springs, or as any other suitable type of spring.

In the first exemplary embodiment, the second thrust bearing (166) is preloaded with springs (198) which are interposed between the shoulder in the third sleeve section (114) and the stationary second thrust bearing component (192) and which urge the stationary second thrust bearing component (192) into engagement with the rotating second thrust bearing component (194). In the first exemplary embodiment, the second thrust bearing (166) is an off-bottom thrust bearing.

Figure 14A:
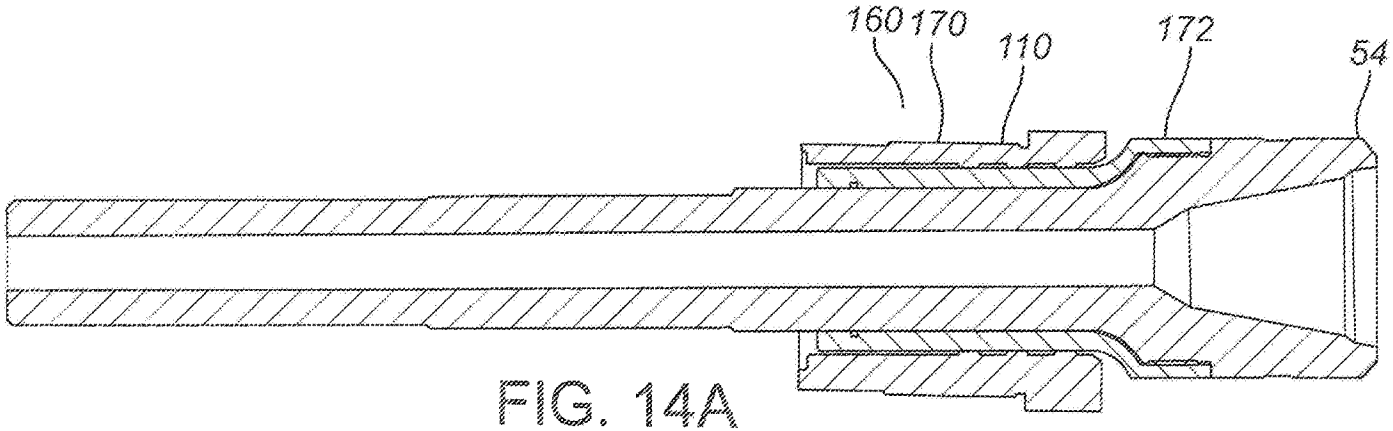
FIGS. 14A-14D depict an exemplary sequence for assembling the bearing section depicted in FIG. 2.
Figure 14B:
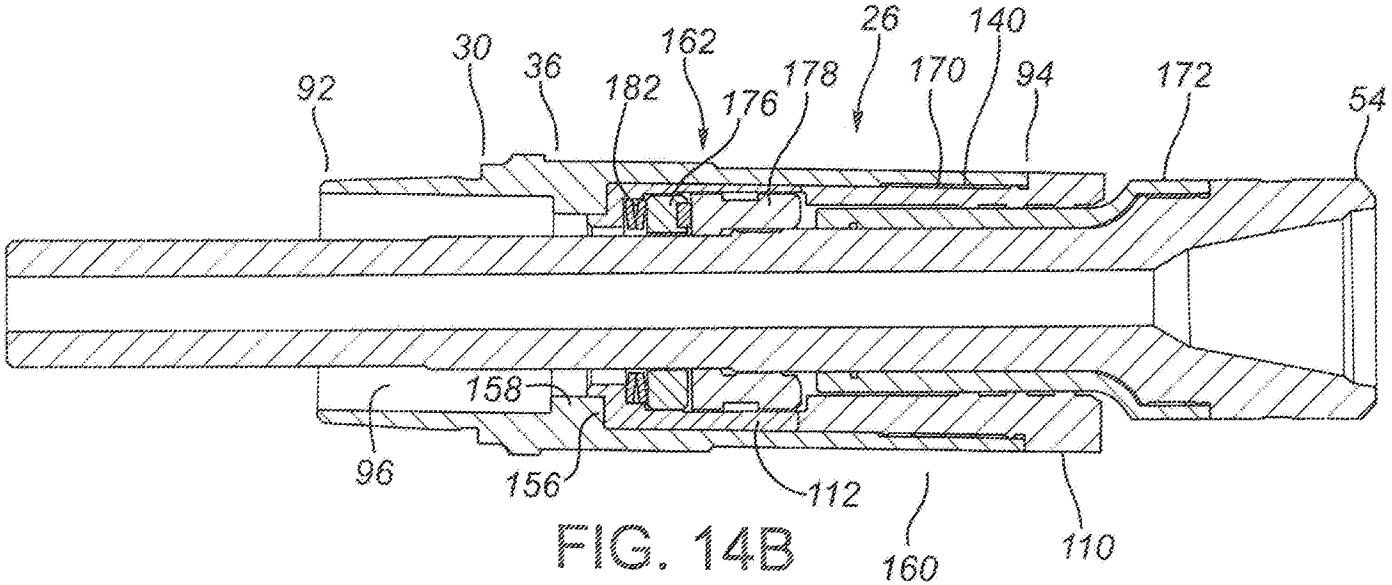
Figure 14C:
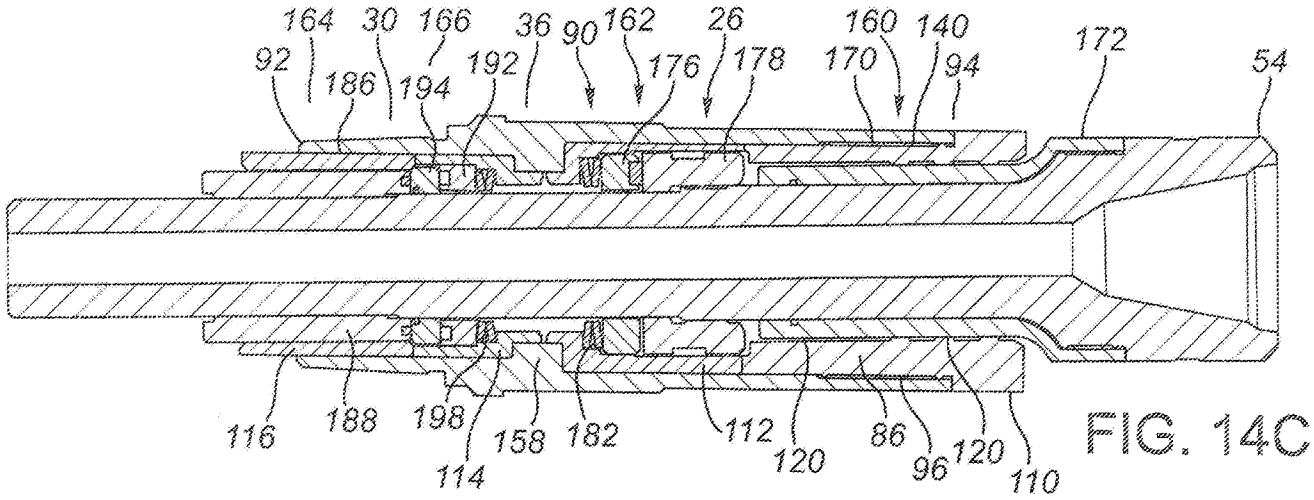
Figure 14D:
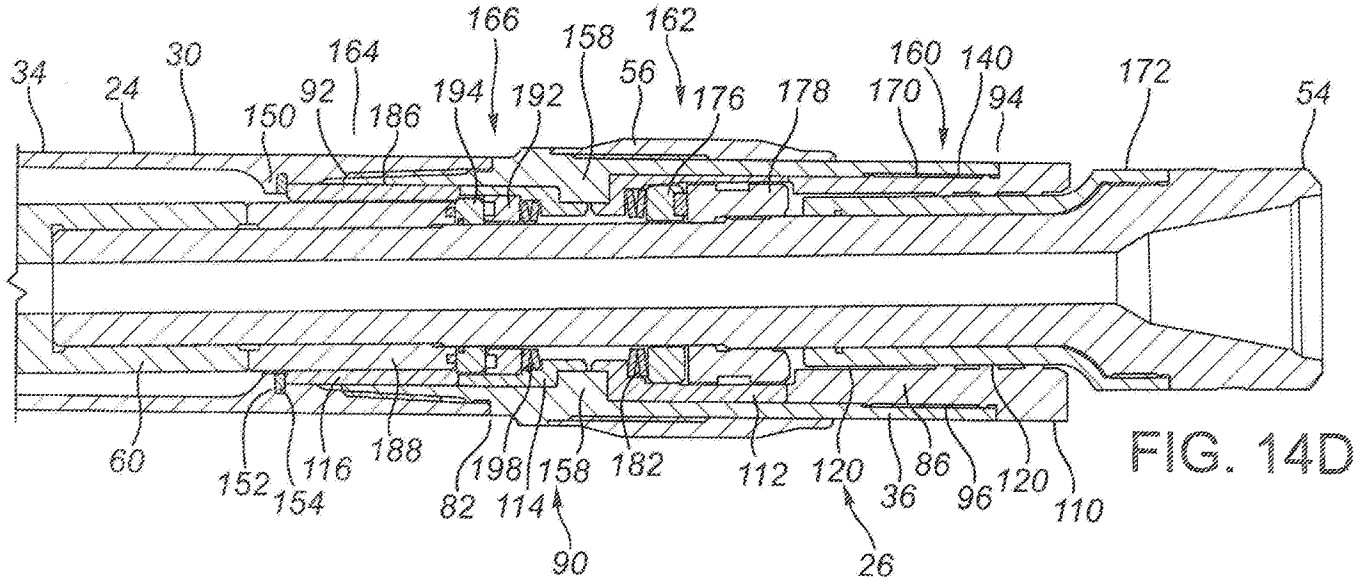

Referring to FIGS. 14A-14D, the bearing section (26) in the first exemplary embodiment of the drilling apparatus (20) may be assembled in the following manner:

1. as depicted in FIG. 14A:
   (a) the rotating first radial bearing component (172) and the first sleeve section (110) comprising the stationary first radial bearing component (170) may be slid onto the driveshaft (54); and
   (b) the rotating first radial bearing component (172) may be threaded onto the driveshaft (54);
2. as depicted in FIG. 14B:
   (a) the rotating first thrust bearing component (178) may be threaded onto the driveshaft (54);
   (b) the second sleeve section (112), the stationary first thrust bearing component (176) and a stack of preloading springs (182) may be assembled together and may then be inserted within the bearing housing bore (96) of the bearing housing (36) from the distal bearing housing end (94);
   (c) the driveshaft (54) may be inserted into the bearing housing bore (96) from the distal bearing housing end (94) so that the complementary engagement surfaces (142) on the first sleeve section (110) and the second sleeve section (112) engage each other; and
   (d) the first sleeve section (110) may be threaded into the distal bearing housing end (94) of the bearing housing (36) to provide the sleeve connection (140);
3. as depicted in FIG. 14C:
   (a) the third sleeve section (114) may be inserted into the bearing housing bore (96) from the proximal bearing housing end (92) so that the complementary engagement surfaces (142) on the second sleeve section (112) and the third sleeve section (114) engage each other;
   (b) a stack of preloading springs (198) and the stationary second thrust bearing component (192) may be inserted within the third sleeve section (114) from the proximal bearing housing end (92);
   (c) the rotating second thrust bearing component (194) may be threaded onto the driveshaft (54); and
   (d) the fourth sleeve section (116) comprising the stationary second radial bearing component (186) may be inserted within the bearing housing bore (96) from the proximal bearing housing end (92) so that the complementary engagement surfaces (142) on the third sleeve section (114) and the fourth sleeve section (116) engage each other;
4. as depicted in FIG. 14D:
   (a) the transmission shaft (60) may be connected with the driveshaft (54);
   (b) the spacer (154) may be inserted within the groove in the transmission housing (34);
   (c) the distal transmission housing end (82) of the transmission housing (34) may be connected with the proximal bearing housing end (92) of the bearing housing (36); and
   (d) the stabilizer (56) may be threaded onto the exterior of the bearing housing (36); and
5. (not shown in FIGS. 14A-14D) the remaining components of the drilling apparatus (20) may be assembled to complete the assembly of the drilling apparatus (20).

Referring now to FIG. 1 with FIGS. 15-29, features of the second exemplary embodiment of the drilling apparatus (20) are described in further detail.

The description of the second exemplary embodiment of the drilling apparatus (20) is limited to the differences between the second exemplary embodiment and the first exemplary embodiment.

In the first exemplary embodiment, the first thrust bearing (162) and the second thrust bearing (166) are located axially on opposite sides of the internal shoulder (158) in the bearing housing bore (96). In the second exemplary embodiment, the internal shoulder (158) in the bearing housing bore (96) is located axially more proximally than in the first exemplary embodiment. As a result, in the second exemplary embodiment, the first thrust bearing (162) and the second thrust bearing (166) are both located axially distal to the internal shoulder (158).

In the second exemplary embodiment, the sleeve assembly (86) comprises five sleeve sections, including a first sleeve section (210), a second sleeve section (212), a third sleeve section (214), a fourth sleeve section (216), and a fifth sleeve section (218).

The first sleeve section (210) in the second exemplary embodiment is substantially similar to the first sleeve section (110) in the first exemplary embodiment except for the configuration of the complementary engagement surfaces (142) on the first sleeve section (210). The fifth sleeve section (218) in the second exemplary embodiment is substantially similar to the fourth sleeve section (116) in the first exemplary embodiment.

In the second exemplary embodiment, the second sleeve section (212) and the third sleeve section (214) contain the first thrust bearing (162) and the second thrust bearing (166) respectively.

In the second exemplary embodiment, the second sleeve section (212) comprises a shoulder which extends radially within the bearing housing bore (96) and which provides a stationary reaction surface for the first thrust bearing (162).

In the second exemplary embodiment, the third sleeve section (214) comprises a shoulder which extends radially within the bearing housing bore (96) and which engages the internal shoulder (158) in the bearing housing (36) to provide complementary engagement surfaces (156) between the bearing housing (36) and the third sleeve section (214) which assist in maintaining the third sleeve section (214) in a fixed axial position relative to the bearing housing (36). The shoulder in the third sleeve section (214) also provides a stationary reaction surface for the second thrust bearing (166).

In the second exemplary embodiment, the fourth sleeve section (216) provides a non-rotatable interengagement between the third sleeve section (214) and the fifth sleeve section (218).

Referring to FIGS. 15-17 and FIGS. 18-19, the first sleeve section (210) and the second sleeve section (212) constitute a pair of adjacent sleeve sections which have adjacent ends in contact with each other. In the second exemplary embodiment, the complementary engagement surfaces (142) between the first sleeve section (210) and the second sleeve section (212) comprise an arrangement of interlocking tabs and recesses at the adjacent ends of the first sleeve section (210) and the second sleeve section (212).

Referring to FIGS. 15-17 and FIGS. 19-20, the second sleeve section (212) and the third sleeve section (214) constitute a pair of adjacent sleeve sections which have adjacent ends in contact with each other. In the second exemplary embodiment, the complementary engagement surfaces (142) between the second sleeve section (212) and the third sleeve section (214) comprise an arrangement of interlocking tabs and recesses at the adjacent ends of the second sleeve section (212) and the third sleeve section (214). In the second exemplary embodiment, the tabs and recesses on the adjacent ends of the second sleeve section (212) and the third sleeve section (214) are different from the tabs and recesses on the adjacent ends of the first sleeve section (210) and the second sleeve section (212).

Referring to FIGS. 15-17 and FIGS. 20-21, the third sleeve section (214) and the fourth sleeve section (216) constitute a pair of adjacent sleeve sections which have adjacent ends in contact with each other. In the second exemplary embodiment, the complementary engagement surfaces (142) between the third sleeve section (214) and the fourth sleeve section (216) comprise an arrangement of interlocking tabs and recesses at the adjacent ends of the third sleeve section (214) and the fourth sleeve section (216). In the second exemplary embodiment, the tabs and recesses on the adjacent ends of the third sleeve section (214) and the fourth sleeve section (216) are similar to the tabs and recesses on the adjacent ends of the first sleeve section (210) and the second sleeve section (212).

Referring to FIGS. 15-17 and FIGS. 21-22, the fourth sleeve section (216) and the fifth sleeve section (218) constitute a pair of adjacent sleeve sections which have adjacent ends in contact with each other. In the second exemplary embodiment, the complementary engagement surfaces (142) between the fourth sleeve section (216) and the fifth sleeve section (218) comprise an arrangement of interlocking tabs and recesses at the adjacent ends of the fourth sleeve section (216) and the fifth sleeve section (218). In the second exemplary embodiment, the tabs and recesses on the adjacent ends of the fourth sleeve section (216) and the fifth sleeve section (218) are similar to the tabs and recesses on the adjacent ends of the second sleeve section (212) and the third sleeve section (214).

In the second exemplary embodiment, the retaining shoulder (150) comprises a discontinuity (152) and a spacer (154), but the spacer (154) merely abuts the discontinuity (152) and is not received within a groove adjacent to the discontinuity (152).

In the second exemplary embodiment, the stationary first thrust bearing component (176) is configured somewhat differently than in the first exemplary embodiment, and the complementary engagement surfaces (180) between the stationary first thrust bearing component (176) and the second sleeve (212) are different from the complementary engagement surfaces (180) in the first exemplary embodiment.

In the second exemplary embodiment, the rotating bearing components (172, 178, 188, 194) are configured somewhat differently than in the first exemplary embodiment. In particular, in the second exemplary embodiment, the rotating second radial bearing component (188) and the rotating second thrust bearing component (194) are separate parts, since they are located on opposite sides axially of the internal shoulder (158) in the bearing housing (36).

In the second exemplary embodiment, the first thrust bearing (162) is preloaded with springs (182) which are interposed between the shoulder in the second sleeve section (212) and the stationary first thrust bearing component (176) and which urge the stationary first thrust bearing component (176) into engagement with the rotating first thrust bearing component (178). In the second exemplary embodiment, the first thrust bearing (162) is an off-bottom thrust bearing.

In the second exemplary embodiment, the stationary second thrust bearing component (192) is configured somewhat differently than in the first exemplary embodiment, and the complementary engagement surfaces (196) between the stationary second thrust bearing component (192) and the third sleeve (214) are different from the complementary engagement surfaces (196) in the first exemplary embodiment.

In the second exemplary embodiment, the second thrust bearing (166) is preloaded with springs (182) which are interposed between the shoulder in the third sleeve section (214) and the stationary second thrust bearing component (192) and which urge the stationary second thrust bearing component (192) into engagement with the rotating second thrust bearing component (194). In the second exemplary embodiment, the second thrust bearing (166) is an on-bottom thrust bearing.

In the second exemplary embodiment, the drilling apparatus (20) comprises a driveshaft catch (220) which is provided as a protrusion on the exterior surface of the rotating first radial bearing component (172) and which is configured to engage a shoulder on the stationary first radial bearing component (170). In the second exemplary embodiment, the protrusion on the exterior surface of the rotating first radial bearing component (172) comprises a collar (222) which is threadably connected with the exterior surface of the rotating first radial bearing component (172).

Figure 29A:
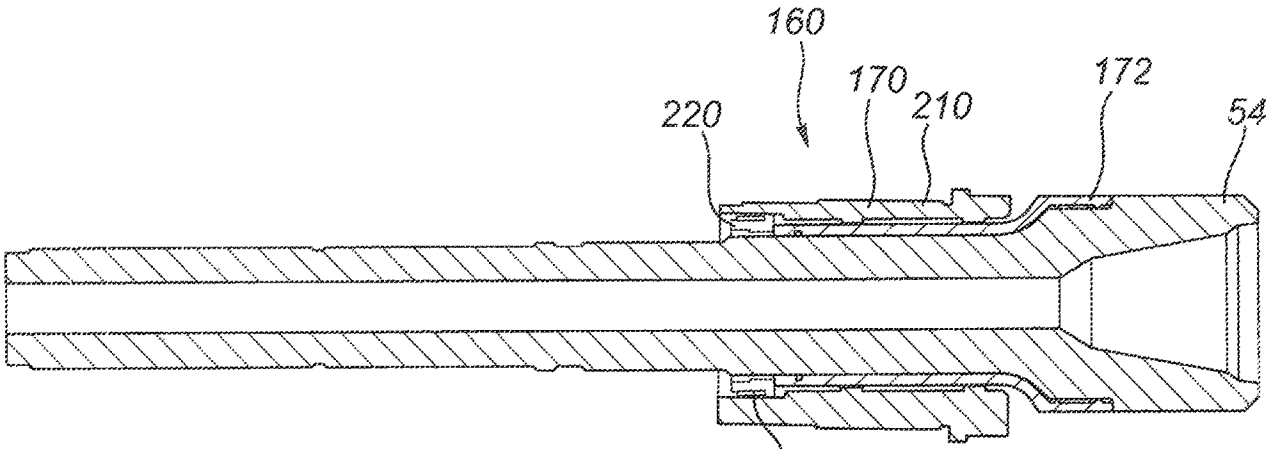
FIGS. 29A-29D depict an exemplary sequence for assembling the bearing section depicted in FIG. 15.
Figure 29B:
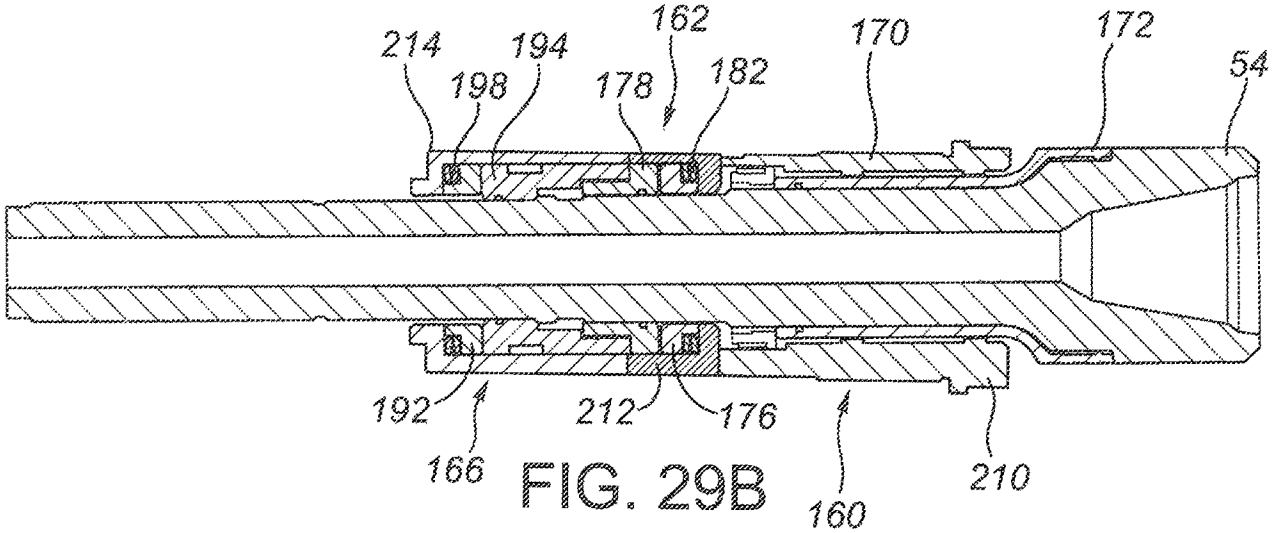
Figure 29C:
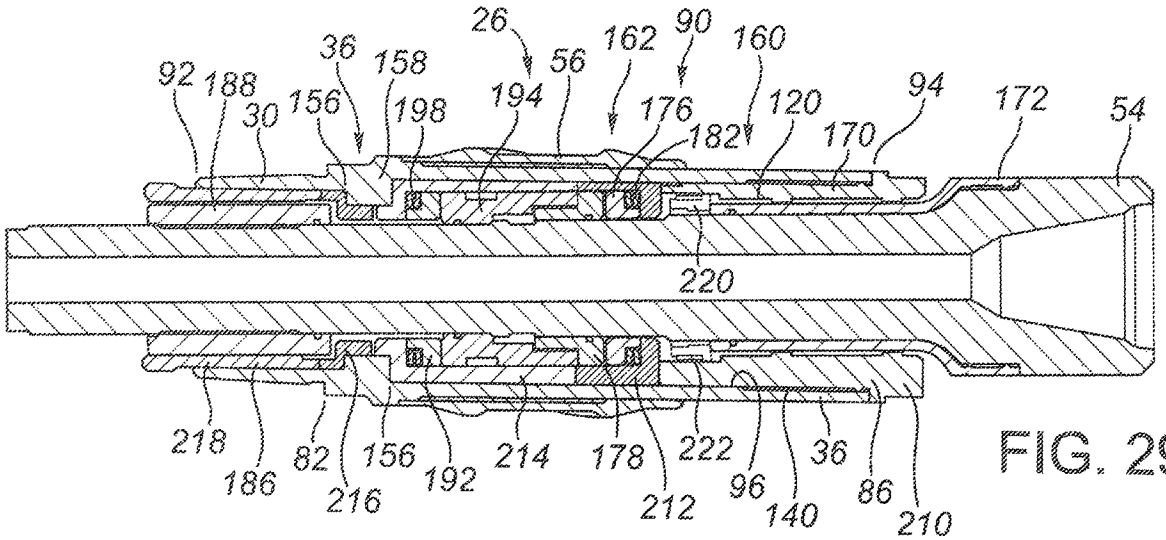
Figure 29D:
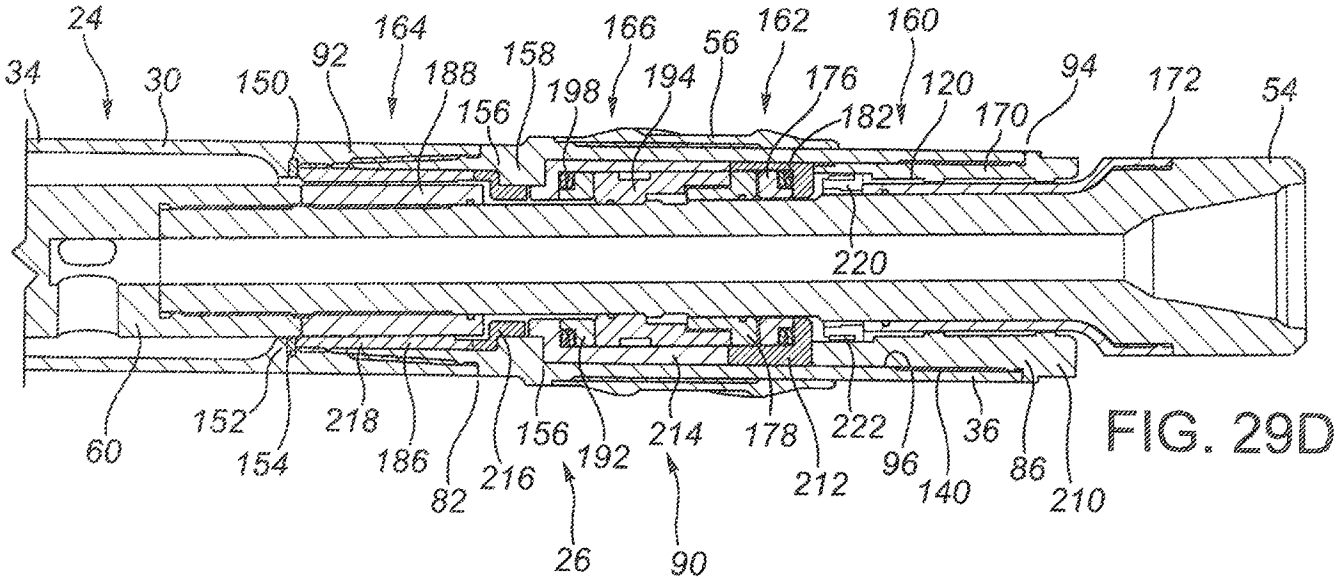

Referring to FIGS. 29A-29D, the bearing section (26) in the second exemplary embodiment of the drilling apparatus (20) may be assembled in the following manner:

1. as depicted in FIG. 29A:
   (a) the rotating first radial bearing component (172) with the driveshaft catch collar (222) and the first sleeve section (210) comprising the stationary first radial bearing component (170) may be slid onto the driveshaft (54); and (b) the rotating first radial bearing component (172) may be threaded onto the driveshaft (54);

2. as depicted in FIG. 29B:
   (a) the second sleeve section (212), a stack of preloading springs (182), the stationary first thrust bearing component (176), the rotating first thrust bearing component (178), the rotating second thrust bearing component (194), the stationary second thrust bearing component (192), a stack of preloading springs (198), and the third sleeve section (214) may be assembled onto the driveshaft (54) so that the complementary engagement surfaces (142) on the first sleeve section (210) and the second sleeve section (212) engage each other and so that the complementary engagement surfaces (142) on the second sleeve section (212) and the third sleeve section (214) engage each other;
3. as depicted in FIG. 29C:
   (a) the driveshaft (54) may be inserted within the bearing housing bore (96) from the distal bearing housing end (94) so that the shoulder on the third sleeve section (214) engages with the internal shoulder (158) in the bearing housing (36);
   (b) the first sleeve section (210) may be threaded into the distal bearing housing end (94) of the bearing housing (36) to provide the sleeve connection (140);
   (c) the fourth sleeve section (216) may be inserted within the bearing housing bore (96) from the proximal bearing housing end (92) so that the complementary engagement surfaces (142) on the third sleeve section (214) and the fourth sleeve section (216) engage each other;
   (d) the rotating second radial bearing component (188) may be threaded onto the driveshaft (54); and
   (e) the fifth sleeve section (218) may be inserted within the bearing housing bore (96) from the proximal bearing housing end (92) so that the complementary engagement surfaces (142) on the fourth sleeve section (216) and the fifth sleeve section (218) engage each other;
4. as depicted in FIG. 29D:
   (a) the transmission shaft (60) may be connected with the driveshaft (54);
   (b) the spacer (154) may be inserted within the transmission housing (34) from the distal transmission housing end (82) so that the spacer (154) abuts the discontinuity (152) in the transmission housing (34);
   (c) the distal transmission housing end (82) of the transmission housing (34) may be connected with the proximal bearing housing end (92) of the bearing housing (36); and
   (d) the stabilizer (56) may be threaded onto the exterior of the bearing housing (36); and
5. (not shown in FIGS. 29A-29D) the remaining components of the drilling apparatus (20) may be assembled to complete the assembly of the drilling apparatus (20).

ADDITIONAL DISCLOSURES

The following are non-limiting, specific embodiments of the drilling apparatus described herein:

Embodiment A

A drilling apparatus comprising a drive section and a bearing section axially distal to the drive section, wherein the bearing section comprises:

(a) a bearing housing, wherein the bearing housing defines a bearing housing bore and wherein the bearing housing bore defines a bearing housing bore axis;
(b) a sleeve assembly received within the bearing housing bore, wherein the sleeve assembly comprises a plurality of axially arranged sleeve sections, wherein the sleeve assembly defines a sleeve assembly bore, wherein the sleeve assembly bore defines a sleeve assembly bore axis, and wherein the sleeve assembly bore axis is oblique to the bearing housing bore axis;
(c) a driveshaft received within the sleeve assembly bore, wherein the driveshaft is rotatable relative to the bearing housing; and
(d) a bearing assembly for rotatably supporting the driveshaft within the sleeve assembly bore.

Embodiment B

The drilling apparatus of Embodiment A wherein the sleeve sections are received within the bearing housing bore so that each of the sleeve sections maintains a fixed angular position relative to the bearing housing.

Embodiment C

The drilling apparatus of any one of Embodiments A or B wherein the sleeve sections are non-rotatably interengaged so that the sleeve sections maintain a fixed angular position relative to each other.

Embodiment D

The drilling apparatus of any one of Embodiments A through C wherein at least one of the sleeve sections is non-rotatably engaged with the bearing housing so that each of the sleeve sections maintains a fixed angular position relative to the bearing housing.

Embodiment E

The drilling apparatus of any one of Embodiments A through D wherein the sleeve sections comprise complementary engagement surfaces and wherein the sleeve sections are non-rotatably interengaged by the complementary engagement surfaces.

Embodiment F

The drilling apparatus of Embodiment E wherein the sleeve sections comprise pairs of adjacent sleeve sections and wherein the complementary engagement surfaces comprise at least one tab on one of a pair of adjacent sleeve sections and at least one recess on the other of a pair of adjacent sleeve sections.

Embodiment G

The drilling apparatus of Embodiment E wherein the sleeve sections comprise pairs of adjacent sleeve sections and wherein the complementary engagement surfaces comprise at least one tab on one of the sleeve sections in each pair of adjacent sleeve sections and at least one recess on the other of the sleeve sections in each pair of adjacent sleeve sections.

Embodiment H

The drilling apparatus of any one of Embodiments A through G wherein the bearing assembly comprises a first radial bearing, wherein the first radial bearing comprises a stationary first radial bearing component, and wherein the stationary first radial bearing component is non-rotatably engaged with the sleeve assembly.

Embodiment I

The drilling apparatus of Embodiment H wherein the stationary first radial bearing component is integral with one of the sleeve sections.

Embodiment J

The drilling apparatus of any one of Embodiments A through I wherein the bearing assembly comprises a first thrust bearing, wherein the first thrust bearing comprises a stationary first thrust bearing component, and wherein the stationary first thrust bearing component is non-rotatably engaged with the sleeve assembly.

Embodiment K

The drilling apparatus of any one of Embodiments A through J wherein the bearing assembly comprises a second radial bearing, wherein the second radial bearing comprises a stationary second radial bearing component, and wherein the stationary second radial bearing component is non-rotatably engaged with the sleeve assembly.

Embodiment L

The drilling apparatus of Embodiment K wherein the stationary second radial bearing component is integral with one of the sleeve sections.

Embodiment M

The drilling apparatus of any one of Embodiments A through L wherein the bearing assembly comprises a second thrust bearing, wherein the second thrust bearing comprises a stationary second thrust bearing component, and wherein the stationary second thrust bearing component is non-rotatably engaged with the sleeve assembly.

Embodiment N

The drilling apparatus of any one of Embodiments A through M wherein the sleeve sections are retained within the bearing housing bore such that each of the sleeve sections maintains a fixed axial position relative to the bearing housing.

Embodiment O

The drilling apparatus of any one of Embodiments A through N wherein the drilling apparatus comprises a retaining shoulder extending radially into the bearing housing bore, wherein one of the sleeve sections is non-rotatably engaged with the bearing housing and non-translatably engaged with the bearing housing by a sleeve connection, and wherein the sleeve sections are retained within the bearing housing bore between the retaining shoulder and the sleeve connection.

Embodiment P

The drilling apparatus of any one of Embodiments A through O wherein the drilling apparatus is a drilling motor for use in drilling a borehole.

Embodiment Q

The drilling apparatus of any one of Embodiments A through P, further comprising a transmission section axially located between the drive section and the bearing section.

Embodiment R

The drilling apparatus of any one of Embodiments A through Q wherein the bearing housing defines a bearing housing axis and wherein the bearing housing axis is parallel with the bearing housing bore axis.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A drilling apparatus comprising a drive section and a bearing section axially distal to the drive section, wherein the bearing section comprises:

(a) a bearing housing, wherein the bearing housing defines a bearing housing bore and wherein the bearing housing bore defines a bearing housing bore axis;

(b) a sleeve assembly received within the bearing housing bore, wherein the sleeve assembly comprises a plurality of axially arranged sleeve sections, wherein the sleeve assembly defines a sleeve assembly bore, wherein the sleeve assembly bore defines a sleeve assembly bore axis, and wherein the sleeve assembly bore axis is oblique to the bearing housing bore axis;

(c) a driveshaft received within the sleeve assembly bore, wherein the driveshaft is rotatable relative to the bearing housing; and (d) a bearing assembly for rotatably supporting the driveshaft within the sleeve assembly bore.

2. The drilling apparatus as claimed in claim 1 wherein the sleeve sections are received within the bearing housing bore so that each of the sleeve sections maintains a fixed angular position relative to the bearing housing.

3. The drilling apparatus as claimed in claim 2 wherein the sleeve sections are non-rotatably interengaged so that the sleeve sections maintain a fixed angular position relative to each other.

4. The drilling apparatus as claimed in claim 3 wherein at least one of the sleeve sections is non-rotatably engaged with the bearing housing so that each of the sleeve sections maintains the fixed angular position relative to the bearing housing.

5. The drilling apparatus as claimed in claim 4 wherein the sleeve sections comprise complementary engagement surfaces and wherein the sleeve sections are non-rotatably interengaged by the complementary engagement surfaces.

6. The drilling apparatus as claimed in claim 5 wherein the sleeve sections comprise pairs of adjacent sleeve sections and wherein the complementary engagement surfaces comprise at least one tab on one of a pair of adjacent sleeve sections and at least one recess on the other of the pair of adjacent sleeve sections.

7. The drilling apparatus as claimed in claim 5 wherein the sleeve sections comprise pairs of adjacent sleeve sections and wherein the complementary engagement surfaces comprise at least one tab on one of the sleeve sections in each pair of adjacent sleeve sections and at least one recess on the other of the sleeve sections in each pair of adjacent sleeve sections.

8. The drilling apparatus as claimed in claim 2 wherein the bearing assembly comprises a first radial bearing, wherein the first radial bearing comprises a stationary first radial bearing component, and wherein the stationary first radial bearing component is non-rotatably engaged with the sleeve assembly.

9. The drilling apparatus as claimed in claim 8 wherein the stationary first radial bearing component is integral with one of the sleeve sections.

10. The drilling apparatus as claimed in claim 8 wherein the bearing assembly comprises a first thrust bearing, wherein the first thrust bearing comprises a stationary first thrust bearing component, and wherein the stationary first thrust bearing component is non-rotatably engaged with the sleeve assembly.

11. The drilling apparatus as claimed in claim 10 wherein the bearing assembly comprises a second radial bearing, wherein the second radial bearing comprises a stationary second radial bearing component, and wherein the stationary second radial bearing component is non-rotatably engaged with the sleeve assembly.

12. The drilling apparatus as claimed in claim 11 wherein the stationary second radial bearing component is integral with one of the sleeve sections.

13. The drilling apparatus as claimed in claim 11 wherein the bearing assembly comprises a second thrust bearing, wherein the second thrust bearing comprises a stationary second thrust bearing component, and wherein the stationary second thrust bearing component is non-rotatably engaged with the sleeve assembly.

14. The drilling apparatus as claimed in claim 10 wherein the bearing assembly comprises a second thrust bearing, wherein the second thrust bearing comprises a stationary second thrust bearing component, and wherein the stationary second thrust bearing component is non-rotatably engaged with the sleeve assembly.

15. The drilling apparatus as claimed in claim 2 wherein the bearing assembly comprises a first thrust bearing, wherein the first thrust bearing comprises a stationary first thrust bearing component, and wherein the stationary first thrust bearing component is non-rotatably engaged with the sleeve assembly.

16. The drilling apparatus as claimed in claim 2 wherein the sleeve sections are retained within the bearing housing bore such that each of the sleeve sections maintains a fixed axial position relative to the bearing housing.

17. The drilling apparatus as claimed in claim 16 wherein the drilling apparatus comprises a retaining shoulder extending radially into the bearing housing bore, wherein one of the sleeve sections is non-rotatably engaged with the bearing housing and non-translatably engaged with the bearing housing by a sleeve connection, and wherein the sleeve sections are retained within the bearing housing bore between the retaining shoulder and the sleeve connection.

18. The drilling apparatus as claimed in claim 2 wherein the drilling apparatus is a drilling motor for use in drilling a borehole.

19. The drilling apparatus as claimed in claim 2, further comprising a transmission section axially located between the drive section and the bearing section.

20. The drilling apparatus as claimed in claim 2 wherein the bearing housing defines a bearing housing axis and wherein the bearing housing axis is parallel with the bearing housing bore axis.

* * * * *